US007561838B2

(12) United States Patent
Sakamaki et al.

(10) Patent No.: US 7,561,838 B2
(45) Date of Patent: Jul. 14, 2009

(54) DEVELOPING APPARATUS FEATURING MAGNETIC SEAL MEMBERS DISPOSED IN DEVELOPER DELIVERY REGIONS

(75) Inventors: Tomoyuki Sakamaki, Toride (JP); Kazukiyo Akashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 171 days.

(21) Appl. No.: 11/510,637

(22) Filed: Aug. 28, 2006

(65) Prior Publication Data

US 2007/0053725 A1 Mar. 8, 2007

(30) Foreign Application Priority Data

Sep. 7, 2005 (JP) ..... 2005-259969

(51) Int. Cl.
*G03G 15/08* (2006.01)

(52) U.S. Cl. ..... 399/269

(58) Field of Classification Search ..... 399/269, 399/267, 104, 272, 273, 274
See application file for complete search history.

(56) References Cited

U.S. PATENT DOCUMENTS 5,177,536 A * 1/1993 Watanabe et al. ..... 399/222
6,029,030 A 2/2000 Yamaji et al. ..... 399/104
6,408,150 B1 * 6/2002 Nishiyama ..... 399/104
6,546,222 B2 4/2003 Sakemi et al. ..... 399/276
6,973,281 B2 * 12/2005 Hirobe et al. ..... 399/269
6,975,825 B2 * 12/2005 Sakamaki et al. ..... 399/269
6,978,108 B2 * 12/2005 Sakamaki ..... 399/267
7,099,609 B2 * 8/2006 Hirobe et al. ..... 399/269
2007/0053724 A1 3/2007 Akashi et al. ..... 399/269

FOREIGN PATENT DOCUMENTS

JP 11-133750 5/1999

* cited by examiner

*Primary Examiner*—Quana M Grainger
(74) *Attorney, Agent, or Firm*—Fitzpatrick, Cella, Harper & Scinto

(57) ABSTRACT

A developing apparatus including a first development sleeve carrying a developer toward a first development area, a second development sleeve carrying the developer from the first sleeve toward a second development area, a first magnet roller disposed in the first sleeve and having a first magnetic pole, a second magnet roller disposed in the second sleeve and having a second magnetic pole, a first magnet member disposed in the vicinity of an axial end of the first sleeve without facing the first magnetic pole, and a second magnet member disposed in the vicinity of an axial end of the second sleeve without facing the second magnetic pole. A surface facing the second sleeve in an end area downstream of the second magnet member in a rotating direction of the second developer carrying member is identical in polarity with the second magnetic pole.

8 Claims, 16 Drawing Sheets

COMPARATIVE EXAMPLE

DEVELOPING APPARATUS FEATURING MAGNETIC SEAL MEMBERS DISPOSED IN DEVELOPER DELIVERY REGIONS

BACKGROUND OF THE INVENTION

1. Field of the Invention

The present invention relates to a developing apparatus for developing an electrostatic image that has been formed through an electrophotographic printing method or an electrostatic recording method on an image bearing member, in particular, having a developer carrying member.

2. Description of the Related Art

UP to now, in an image forming apparatus such as an electrophotographic copying machine, a powder cloud method, a cascade method, and a magnetic brush method have been known as methods employed for developing apparatuses that are applied to the image forming apparatuses. Among those, in a case of the magnetic brush method of a two-component developing system, a two-component developer mixedly containing magnetic carriers and toner therein is used as the developer. Then, the developer is attracted by magnetic field generating means and stands like the ears of rice in a shape of brush on a magnetic pole portion, and an electrostatic latent image on a drum-shaped electrophotographic photosensitive member (hereinafter referred to as "photosensitive drum") which serves as the image bearing member is rubbed by the developer to thereby develop and form an image. In this event, because the magnetic carrier per se in the developer serves as a soft developing electrode, it is possible to make the toner adhere to the electrostatic latent image in proportion to charge density of the electrostatic latent image. In other words, the magnetic brush method of the two-component developing system is suitable for a reproduction of a gradation image. Also, the magnetic brush method of the two-component developing system has a feature that the developing apparatus per se can be downsized.

The magnetic brush developing method using a development sleeve which is the developer carrying member is generalized as a magnetic brush developing apparatus of the two-component developing system.

In the magnetic brush developing method, in order to efficiently develop the electrostatic latent image on the photosensitive drum, the two-component developer containing magnetic powders, for example, magnetic carriers which are ferrite or the like, and toner in which pigment is dispersed in a resin are agitated and mixed together. The agitation and mixture of the developer allow the toner to carry electric charges through frictional charge attributable to the friction between the developers. On the other hand, the developer is held by the development sleeve serving as a hollow cylindrical developer carrying member which has the magnetic pole therein and is made of a nonmagnetic material. The developer that is held by the development sleeve is transported to a development area that faces the photosensitive drum from a developer container by using the development sleeve. The developer that has been transported to the development area is stood like the ears of rice through an action of the magnetic field in the development area, and rubs the surface of the photosensitive drum. As a result, the electrostatic latent image that has been formed on the photosensitive drum is developed by the developer.

The two-component magnetic brush developing method using the development sleeve is mainly employed in various products, typical examples of which include a monochrome digital copying machine and a full color copying machine requiring a high image quality.

Up to now, in a case where a rotation movement speed of the photosensitive drum is relatively low, that is, in a case of a copying machine having relatively low operating speed, a sufficient and excellent developed image is obtained with a short development period. For that reason, an excellent image is obtained even when a number of the development sleeves is one.

However, in a case where the rotation movement rate of the photosensitive drum becomes higher in a course of a demand for increasing the operating speed of the copying machine in recent years, it is not always possible that proper image formation can be conducted by one development sleeve.

As a countermeasure against the problem described above, there is a method in which peripheral speed of the development sleeve is increased to enhance development efficiency. However, a centrifugal force that is exerted on the developer constituting the magnetic brush becomes larger as the peripheral speed of the development sleeve increases. This increases a scattering rate of the developer, induces contamination of an interior of the copying machine, and deteriorates functionalities of the apparatus.

Under the above-mentioned circumstances, as another countermeasure, there has been proposed a so-called multi-stage magnetic brush developing method using two or more developer carrying members such as the development sleeves. That is, in the multi-stage magnetic brush developing method, a plurality of development sleeves are disposed in such a manner that peripheral surfaces thereof are brought in vicinity of each other so as to be adjacent to each other. Then, the developer is continuously transported through the respective peripheral surfaces, and the development period is extended to enhance development performance.

Now, an example of the developing apparatus of the multi-stage magnetic brush developing system having two conventional development sleeves is shown in FIG. 13.

A developing apparatus 104 includes a developer container 122 that is disposed in parallel to a photosensitive drum 101, and an interior of the developer container 122 is compartmented into a development chamber R1 and an agitation chamber R2 by a partition 123 that is in parallel to the photosensitive drum 101. A developer 120 into which the toner particles and the magnetic carriers are mixed together is housed in the development chamber R1 and the agitation chamber R2.

A transporting screw 124 is housed in the development chamber R1, and the transporting screw 124 transports the developer 120 along a longitudinal direction of the developer container 122 which is in parallel to the photosensitive drum 101 through rotational driving. A transporting screw 125 is housed in the agitation chamber R2, and transports the developer 120 along a longitudinal direction of the developer container 122 which is in parallel to the photosensitive drum 101 through rotation driving. A developer transporting direction of the transporting screw 125 is opposite to that of the transporting screw 124.

Openings 123*a* and 123*b* are defined in the partition 123 at a back side and a front side of FIG. 13 as can be understood with reference to FIG. 14. The developer 120 that has been transported by the transporting screw 124 is transferred to the transporting screw 125 from the opening 123*a*, and the developer 120 that has been transported by the transporting screw 125 is transferred to the transporting screw 124 from the opening 123*b*.

An opening portion is defined at a portion of the developer container 122 in vicinity of the photosensitive drum 101, and two developer carrying members consisting of a first development sleeve 126 and a second development sleeve 128 which are made of a non-magnetic material are disposed in the opening portion. The first development sleeve 126 is disposed opposite to the photosensitive drum 101 to define a development area A1, and the second development sleeve 128 is disposed opposite to the photosensitive drum 101 to define a development area A2.

Of the two developer carrying members, the first development sleeve 126 that is disposed opposite to the photosensitive drum 101 at an upstream side in a rotating direction "a" of the photosensitive drum 101 rotates in a direction indicated by an arrow "b" (in a direction opposite to the rotating direction "a" of the photosensitive drum 101).

Also, in this example, a blade-shaped developer regulating member (layer thickness regulating blade) 121 is disposed at a top end of the opening portion of the developer container 122, that is, upstream of the development area A1 in the rotating direction of the development sleeve 126 in general. The development sleeve 126 carries and transports the developer 120 to the first development area A1 after the retained developer is regulated to an appropriate developer layer thickness by the layer thickness regulating blade 121.

A roller-shaped first magnetic field generating means (hereinafter referred to as "magnet roller") 127 is fixed and disposed within the development sleeve 126. The first magnet roller 127 has a development magnetic pole S1 that faces the first development area A1. The magnetic brush of the developer is formed through a development magnetic field that is developed in the first development area A1 by the development magnetic pole S1, and the magnetic brush comes into contact with the photosensitive drum 101 rotating in the direction indicated by the arrow "a" in the first development area A1 to develop the electrostatic latent image in the first development area A1.

The first magnet roller 127 has N1, S2, N2, and N3 poles in addition to the above-mentioned development magnetic pole S1, and the N2 pole and the N3 pole are identical in polarity with each other and adjacent to each other within the developer container 122 to develop a repulsive magnetic field, thus producing a barrier with respect to the developer 120.

In addition, the second development sleeve 128 that is a second developer carrying member is disposed below the first development sleeve 126 and at a downstream side in the rotating direction "a" of the photosensitive drum 101. Moreover, the second development sleeve 128 is disposed in an area substantially facing both the first development sleeve 126 and the photosensitive drum 101, and is also located rotatably in a direction indicated by an arrow "c" which is the same direction as that of the first development sleeve 126.

The second development sleeve 128 is made of a non-magnetic material, as with the first development sleeve 126, and a roller-shaped second magnet roller 129 that is a second magnetic field generating means is located in a non-rotating state in the interior of the second development sleeve 128. Also, the second magnet roller 129 has five poles consisting of magnetic poles S3, N4, S4, N5, and S5.

The developer 120 is transported in the stated order of N2→S2→N1→S1→N3 on the first development sleeve 126. Thereafter, the developer on the first development sleeve 126 is moved to the second development sleeve 128, and is transported in the stated order of S3→N4→S4→N5→S5 on the second development sleeve 128. In this example, the developer is transferred by the poles substantially facing each other and having the polarities different from each other (i.e., N3 pole and S3 pole). This is because in a case where the poles are identical in polarity with each other, the magnetic force lines are not produced and stable transfer cannot be conducted.

In the above-mentioned structure, the magnetic brush produced in the N4 pole comes into contact with the photosensitive drum 101 at an opposing portion of the second development sleeve 128 and the photosensitive drum 101, that is, the second development area A2. Then, the electrostatic latent image on the photosensitive drum 101 which has passed through the first development area A1 is further subjected to a second development process. In this way, the two development processes are conducted to achieve high development efficiency.

As described above, with the structure in which two development sleeves 126 and 128 are disposed, for example, even if the development period becomes shorter as the peripheral speed of the photosensitive drum 101 increases, high development efficiency can be achieved, thereby making it possible to excellently form an image without deterioration of the development density and occurrence of density unevenness.

Incidentally, the developer 120 within the developer container 122 is transferred to a portion of a bearing 140 of the development sleeves 126 and 128 shown in FIG. 15A along the surfaces of the development sleeves 126 and 128 by circulation within the developer container 122. For that reason, the developer enters the portion of the bearing 140 and stays within the bearing 140 to inhibit the function thereof. As a result, there is a case in which a smooth rotation of the development sleeves 126 and 128 is disabled, or the developer passes through the portion of the bearing 140, causing the developer to leak out from the developer container 122 or scatter.

To cope with the scattering of the developer from the end of the development sleeve, there has been proposed a method in which elastic seal members are fitted onto both ends of the development sleeves, and the ends of the seal members are sealed to prevent the toner from leaking.

However, in the above-mentioned seal structure, because the elastic sealing members are fitted onto the outer peripheral surfaces of the development sleeves under pressure, there arise such problems that a load on the development sleeves becomes large, and the sealing property is deteriorated due to the deterioration of the elastic seal members.

Under such the circumstances, there has been proposed a developing apparatus using a magnetically attractive toner or carrier, in which magnetic sealing is conducted by magnetic force generating means (for example, refer to JP 11-133750 A).

Shown in FIG. 15B is a structure in which a magnetized magnetic seal member MP is disposed on an opposing surface with respect to a surface of a development sleeve SL at a given gap to magnetically attract and hold the developer.

The above-mentioned magnetic seal structure is advantageous in that a rotation load of the development sleeve SL is reduced because the development sleeve SL and the magnetic seal member MP are out of contact, and that the lifetime is prolonged because the development sleeve SL and the magnetic seal member MP are not deteriorated due to the friction.

When a plate-shaped magnet is disposed as the magnetic seal member MP to surround the development sleeve SL in a non-contacting fashion, the magnetic brush is produced between a magnetic roller MR and a magnet MP within the development sleeve SL by using the developer, thereby making it possible to prevent the leakage of the developer. In the developing apparatus shown in FIG. 13, in a case of using a magnet plate having one surface of N pole and the other surface of S pole as the magnet MP, it is desirable that a surface having a pole different in polarity from a pole (N2 and N3, and S3 and S5) that produces the repulsive magnetic field of the magnet roller is a surface at the development sleeve side. In a case where the above-mentioned structure is not applied, the leakage of the developer in the longitudinal direction of the sleeve is liable to occur. The reasons will be described below.

A description will be given with reference to FIGS. 16A to 16C and FIGS. 17A to 17C. In a case where the repulsive magnetic field and the magnetic seal member are identical in polarity with each other while facing each other, the repulsive magnetic field is also produced between the repulsive magnetic field and the magnetic seal member. For that reason, as shown in FIG. 16A, the line of magnetic force of the magnetic seal is unintentionally bent toward the outside of the longitudinal direction of the development sleeve SL and extended. In this case, because the developer is arranged along the line of magnetic force as shown in FIG. 16B, the developer is extended toward the direction of the end of the development sleeve SL, and the developer is liable to leak in the direction of the end thereof.

FIG. 16C schematically shows a force that is applied to the magnetic carrier in an area surrounded by the magnetic seal member MP and the development sleeve SL. The arrows indicate a direction of force at that position, and a length of the arrow indicates a magnitude of the force.

In a case where the magnets have the same polarity facing each other, an area (where the direction of the force exerted on the magnet is inverted), in which there is substantially no magnetic force exerted on the magnetic carrier between the magnets, continuously exists in the longitudinal direction between the magnets. In FIG. 16C, an area in which there is substantially no magnetic force exerted on the magnetic carrier is designated by a mark ○.

However, as shown in FIG. 16C, in a case where the area in which there is substantially no force exerted on the magnetic carrier continuously exists between the magnetic seal member MP and the development sleeve SL in the longitudinal direction, no magnetic carrier is attracted to the magnetic seal member MP or the magnet roller MR. For that reason, it is possible to leak the developer according to a flow indicated by a dotted arrow shown in FIG. 16C. As a result, the developer is liable to flow out of the development area, thereby making it impossible to exercise the excellent sealing property.

Under the circumstances, there has been proposed a structure in which the repulsive magnetic field and the magnetic seal member are different in polarity from each other while facing each other.

In other words, when the repulsive magnetic field and the magnetic seal member are different in polarity from each other while facing each other, since the line of magnetic force of the magnetic seal is extended toward the direction of the development sleeve as shown in FIG. 17A, it becomes difficult to extend the line of magnetic force of the magnetic seal toward the outside of the longitudinal direction. As a result, it becomes difficult for the developer to leak toward the direction of the end of the development sleeve. In this situation, the developer is extended toward the direction of the development sleeve as shown in FIG. 17B, and the magnetic brush is produced between the development sleeve SL and the magnetic seal member MP by the developer. The magnetic brush functions to seal the developer that is to leak toward the end direction, and it is further suppresses leakage of the developer.

On the other hand, in a case where the repulsive magnetic field and the magnetic seal member are identical in polarity with each other while facing each other as described above, as shown in FIG. 16B, the magnetic brush is not extended toward the development sleeve direction from the magnetic seal member MP. Therefore, there is an area in which no developer exists between the magnetic seal member MP and the development sleeve SL, and the developer is liable to leak.

FIG. 17C schematically shows a force that is exerted on the magnetic carrier in an area surrounded by the magnetic seal member MP and the development sleeve SL as in FIG. 16C.

In a case where the magnets are different in polarity from each other while facing each other, an area (indicated by a symbol "O") in which there is substantially no magnetic force exerted on the magnetic carrier between the magnets exists, but does not continuously exist between the magnets. For that reason, the magnetic carrier in the area surrounded by the magnetic seal member MP and the development sleeve SL is always attracted to the magnetic seal member MP and the magnet roller MR during a process in which the magnetic carrier is moved in the direction of the end of the development sleeve. As a result, it is difficult to that the developer flows out of the development area, thereby making it possible to exercise the excellent seal property.

Also, there has been proposed a structure using magnets in which NS poles are magnetized to multiple magnetic poles on an inner peripheral surface as the magnetic seal member MP. In the above-mentioned structure, because the line of magnetic force is extended between the multiple magnetic poles of the magnetic seal member, it is difficult that the line of magnetic force is extended to the outside of the longitudinal direction of the development sleeve, whereby excellent property can be exercised.

In a case where the above-mentioned magnetic seal structure is applied to the magnetic brush developing apparatus having the two development sleeves shown in FIG. 13, there arise the following problems.

As shown in FIG. 18, in the case of using magnet plates 130 and 131 each having one surface of N pole and a back surface of S pole as the magnetic seal member, the upstream development sleeve 126 has an S pole surface that is different in polarity from the repulsive magnetic poles (N2 and N3) as the inner peripheral surface. Also, the downstream development sleeve 128 has an N pole surface that is different in polarity from the repulsive magnetic pole (S3 and S5) as the inner peripheral surface. From the viewpoint of the above-mentioned conventional art, the above-mentioned structure appears to suppress the leakage of the developer to the outside of the development area, and exert the excellent sealing property.

However, according to the inventors' study, it has been found that in the above-mentioned structure, the developer is leaked in the downstream sleeve rotating direction from a space between the upstream and downstream development sleeves 126 and 128 in the end of the development sleeve. The reasons will be described below.

Of the S3 pole and the S5 pole which produce the repulsive magnetic field of the downstream development sleeve 128, the S3 pole also serves as a delivery pole that receives the developer from the upstream development sleeve 126. As a result, because the upstream development sleeve 126 exists at an opposing portion of the S3 pole, the magnetic seal member 131 is capable of extending only up to the middle of the repulsive magnetic field as shown in FIG. 18. For that reason, the magnetic seal member 131 does not face the S3 pole of the delivery pole.

However, because the line of magnetic force is developed between the magnetic seal member 131 and the S3 pole of the delivery pole, a part of a developer that has been caught by the magnetic seal member 131 is attracted to the S3 pole of the delivery pole and moved. The developer that has been moved to the S3 pole from the magnetic seal member 131 at the end of the development sleeve has no magnetic seal member at a side opposite to the S3 pole, and leaks in the development sleeve end direction. The developer that has leaked out in the end direction is transported with the rotation of the development sleeve, and leaked from the space between the upstream and downstream development sleeves 126 and 128.

Similarly, in the case of a structure using a magnet, whose NS poles are magnetized to the multiple magnetic poles on the inner peripheral surface, as the magnetic seal member, because the line of magnetic force is formed between the magnetic seal member and the S3 pole of the delivery pole, the developer is leaked from a space between the upstream and downstream development sleeves as in the above-mentioned case.

SUMMARY OF THE INVENTION

Under the above-mentioned circumstances, an object of the present invention is to provide a developing apparatus having a plurality of developer carrying members for preventing a developer from leaking from a space between two developer carrying members in a developer carrying member rotating direction when an end of a developer carrying member is sealed by using a magnet member.

In order to achieve the above-mentioned object, a developing apparatus for developing an electrostatic image on an image bearing member by using a developer containing magnetic particles therein, the developing apparatus includes: a developer container, which contains the developer; a first developer carrying member that is rotatably disposed within the developer container, for carrying and transporting the developer toward a first development area; a second developer carrying member that is rotatably disposed in vicinity of the first developer carrying member within the developer container, for carrying and transporting the developer delivered from the first developer carrying member toward a second development area in a developer delivery region; a first magnetic field generating means having a plurality of magnetic poles which is disposed within the first developer carrying member, the first magnetic field generating means having a first magnetic pole at a position facing the developer delivery region; a second magnetic field generating means having a plurality of magnetic poles which is disposed within the second developer carrying member, the second magnetic field generating means having a second magnetic pole that is different in polarity from the first magnetic pole at a position facing the developer delivery region; a first magnet member disposed in the vicinity of an end of the first developer carrying member in an axial direction thereof along a peripheral surface of the first developer carrying member to avoid facing the first magnetic pole; and a second magnet member disposed in the vicinity of an end of the second developer carrying member in an axial direction thereof along a peripheral surface of the second developer carrying member to avoid facing the second magnetic pole, a surface facing the second developer carrying member in an end area downstream of the second magnet member in a rotating direction of the second developer carrying member being identical in polarity with the second magnetic pole.

Further features of the present invention will become apparent from the following description of exemplary embodiments with reference to the attached drawings.

DESCRIPTION OF THE EMBODIMENTS

Now, a description will be given in more detail of a developing apparatus and an image forming apparatus according to the present invention with reference to the accompanying drawings.

First Embodiment

First, a description will be provided of a schematic structure of an image forming apparatus according to an embodiment of the present invention, and thereafter a description will be provided of a developing apparatus that constitutes a characteristic portion of the present invention. In this embodiment, the image forming apparatus is directed to a multicolor image forming apparatus of a tandem type using an electrophotographic printing method. However, the present invention is not limited to the above-mentioned structure.

According to this embodiment, the multicolor image forming apparatus has a plurality of image formation sections (i.e., image formation stations) disposed from an upstream side to a downstream side along a rotating direction (i.e., a direction indicated by an arrow R7) of an intermediate transfer belt 7 as an intermediate transfer member. In this embodiment, the image formation sections are constituted of four image formation sections P (i.e., PY, PM, PC, PK) consisting of yellow Y, magenta M, cyan C, and black K.

The respective image formation sections P (i.e., PY, PM, PC, PK) are substantially identical in structure with each other, and include drum-shaped electrophotographic photosensitive members, that is, photosensitive drums 1 (i.e., 1*a*, 1*b*, 1*c*, and 1*d*) as image bearing members, respectively. In a full-color image, images of yellow (Y), magenta (M), cyan (C), and black (K) are formed on the photosensitive drums 1 (i.e., 1*a*, 1*b*, 1*c*, and 1*d*), respectively.

Figure 1:
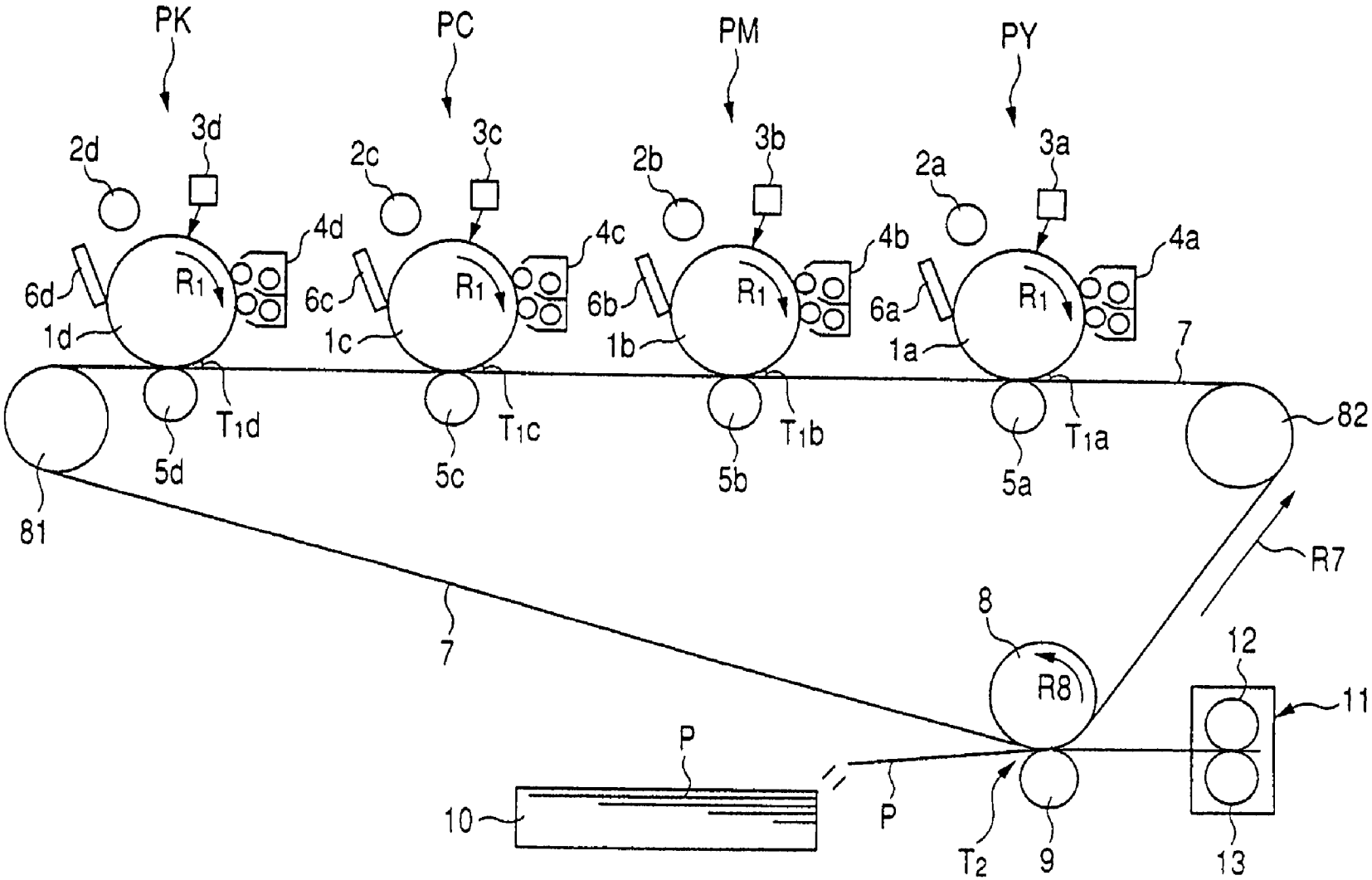
FIG. 1 is a cross-sectional view schematically showing a structure of an image forming apparatus using a developing apparatus according to an embodiment of the present invention.

In more detail, the photosensitive drums 1 (i.e., 1*a*, 1*b*, 1*c*, and 1*d*) are rotationally driven in a direction indicated by an arrow R1 (i.e., clockwise in FIG. 1), respectively. Chargers (i.e., charging means) 2 (i.e., 2*a*, 2*b*, 2*c*, and 2*d*), exposing devices (i.e., latent image forming means) 3 (i.e., 3*a*, 3*b*, 3*c*, and 3*d*), and developing apparatuses (i.e., developing means) 4 (i.e., 4*a*, 4*b*, 4*c*, and 4*d*) are disposed approximately in the stated order along the rotating direction in the periphery of the respective photosensitive drums 1 (i.e., 1*a*, 1*b*, 1*c*, and 1*d*). Also, primary transfer rollers (i.e., primary transfer means) 5 (i.e., 5*a*, 5*b*, 5*c*, and 5*d*) and drum cleaners (i.e., cleaning devices) 6 (i.e., 6*a*, 6*b*, 6*c*, and 6*d*) are disposed along the rotating direction thereof in the periphery of the respective photosensitive drums (i.e., 1*a*, 1*b*, 1*c*, and 1*d*).

) The intermediate transfer belt 7 is extended around support rollers 81 and 82, and a secondary transfer opposed roller 8 that also functions as a driving roller. The intermediate transfer belt 7 rotates in a direction indicated by an arrow R7 with the rotation of the secondary transfer opposed roller 8 in a direction indicated by an arrow RB. The rotating speed of the intermediate transfer belt 7 is set to be substantially identical with the rotating speed (i.e., process speed) of the above-mentioned respective photosensitive drums 1 (i.e., 1*a*, 1*b*, 1*c*, and 1*d*).

Also, the intermediate transfer belt 7 is pressed by the primary transfer rollers 5 (i.e., 5*a*, 5*b*, 5*c*, and 5*d*) from the back surface side, and the front surface of the intermediate transfer belt 7 is abutted against the photosensitive drums 1 (i.e., 1*a*, 1*b*, 1*c*, and 1*d*). Primary transfer nips (i.e., primary transfer sections) T1 (i.e., T1*a*, T1*b*, T1*c*, and T1*d*) are formed between the intermediate transfer belt 7 and the respective photosensitive drums 1.

A secondary transfer roller (i.e., secondary transfer means) 9 is disposed at a position corresponding to the secondary transfer opposed roller 8. The secondary transfer roller 9 nips the intermediate transfer belt 7 in association with the secondary transfer opposed roller 8, and a secondary transfer nip (i.e., secondary transfer section) T2 is formed between the secondary transfer roller 9 and the intermediate transfer belt 7.

Transferring materials P that are subjected to image formation are housed in a state where the transferring materials P are stacked on a sheet feed cassette 10. The transferring materials P are supplied to the above-mentioned secondary transfer nip section T2 by a sheet feeding device (not shown) having a sheet feed roller, a transport roller, and a registration roller.

A fixing device 11 having a fixing roller 12 and a pressure roller 13 that is pressed on the fixing roller 12 is disposed downstream of the secondary transfer nip section T2 along the feeding direction of the transferring material P. A sheet discharge tray (not shown) is disposed downstream of the fixing device 11.

In the image forming apparatus structured as described above, a toner image of four full colors is formed on the transferring material P as follows.

First, the photosensitive drums 1 (i.e., 1*a*, 1*b*, 1*c*, and 1*d*) are rotationally driven by a photosensitive drum driving motor (not shown) at a given process speed in a direction indicated by an arrow R1. Then, the photosensitive drums 1 are uniformly charged to a given polarity and potential by the chargers 2 (i.e., 2*a*, 2*b*, 2*c*, and 2*d*). The photosensitive drums 1 (i.e., 1*a*, 1*b*, 1*c*, 1*d*) that have been charged are exposed on the basis of image information by the exposing devices 3 (i.e., 3*a*, 3*b*, 3*c*, 3*d*), and the electric charges are removed from the exposed portions to form the electrostatic latent images for the respective colors.

The electrostatic latent images on those photosensitive drums 1 (i.e., 1*a*, 1*b*, 1*c*, and 1*d*) are developed as the toner images of the respective colors consisting of yellow (Y), magenta (M), cyan (C), and black (K) by the developing apparatuses 4 (i.e., 4*a*, 4*b*, 4*c*, and 4*d*).

Those toner images of four colors are sequentially primarily transferred onto the intermediate transfer belt 7 by the primary transfer rollers 5 (i.e., 5*a*, 5*b*, 5*c*, and 5*d*) in the primary transfer nips Ti (i.e., T1*a*, T1*b*, T1*c*, and T1*d*). Thus, the toner images of four colors are superimposed on the intermediate transfer belt 7.

The toner (i.e., residual toner) that has remained on the photosensitive drums 1 (i.e., 1*a*, 1*b*, 1*c*, and 1*d*) without being transferred onto the intermediate transfer belt 7 are removed by drum cleaners 6 (i.e., 6*a*, 6*b*, 6*c*, and 6*d*). The photosensitive drums 1 (i.e., 1*a*, 1*b*, 1*c*, and 1*d*) from which the residual toners has been removed are subjected to subsequent image formation.

The toner image of four colors which have been superimposed on the intermediate transfer belt 7 in the manner described above is secondarily transferred onto the transferring material P. The transferring material P that has been fed from the sheet feed cassette 10 by the feeding device is supplied to the secondary transfer nip T2 by the registration roller (not shown) at a timing in accordance with the toner image on the intermediate transfer belt 7. The toner images of four colors on the intermediate transfer belt 7 are collectively and secondarily transferred onto the supplied transferring material P in the secondary transfer nip T2 by using the secondary transfer roller 9.

The transferring material P on which the toner image of four colors has been secondarily transferred is fed to the fixing device 11. The transferring material P is then heated and pressurized to fix the toner image on the surface. The transferring material P on which the toner image has been fixed is discharged to the sheet discharge tray.

With the above-mentioned operation, the image formation of four full colors has been completed with respect to one surface (i.e., front surface) of a single transferring material P.

Figure 2:
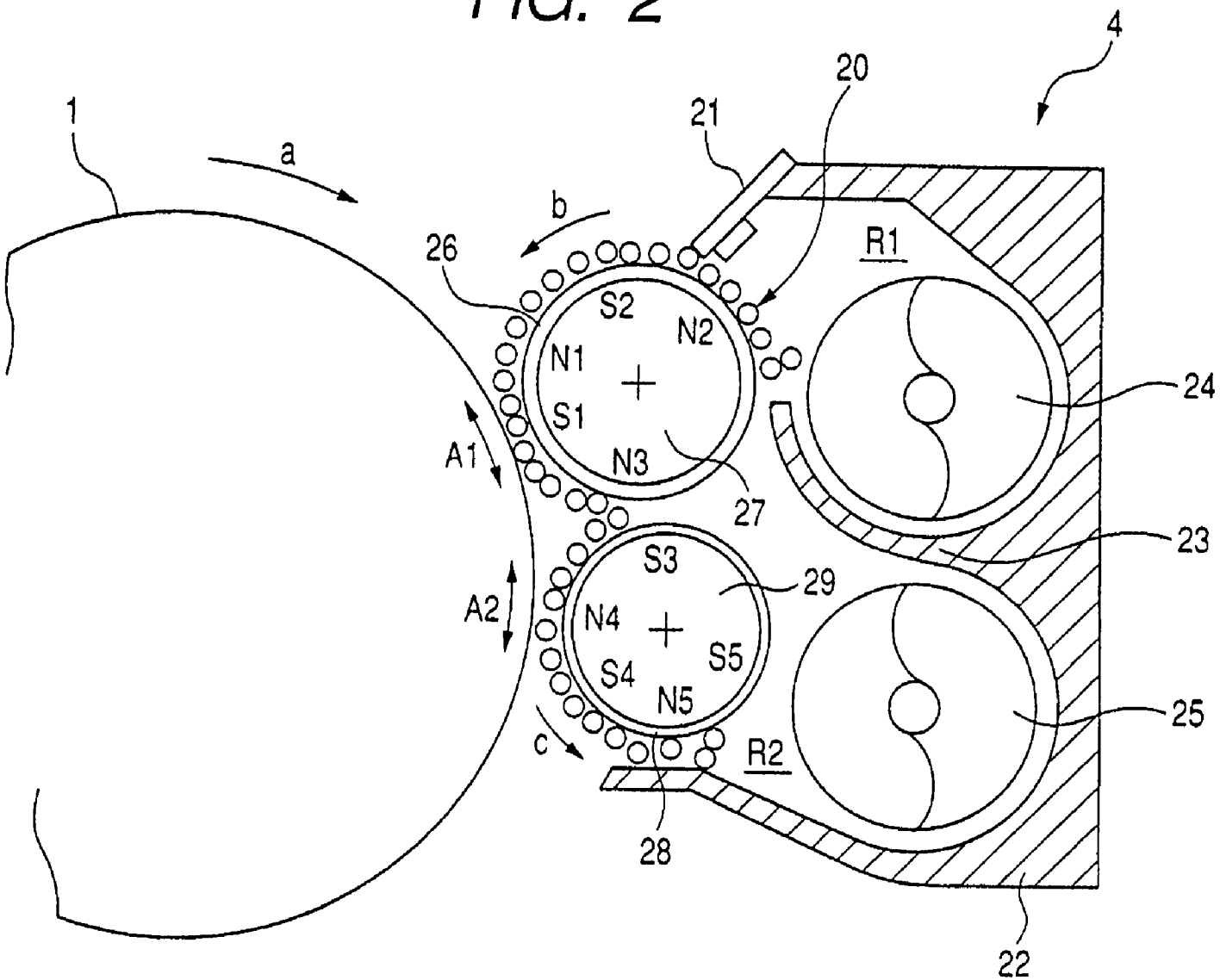
FIG. 2 is a cross-sectional view schematically showing a structure of a developing apparatus according to an embodiment of the present invention.
Figure 3:
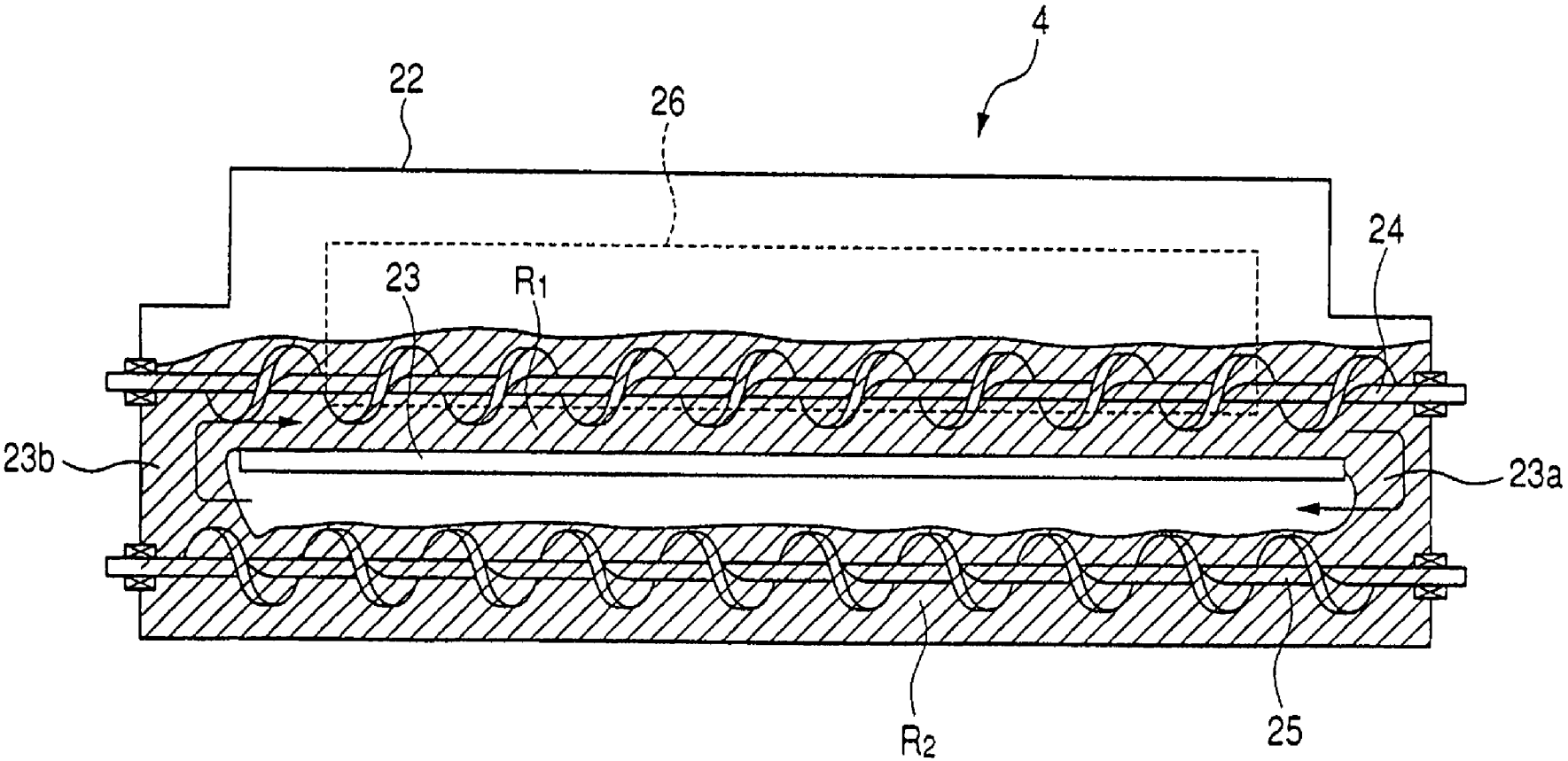
FIG. 3 is a lateral cross-sectional view schematically showing a structure of the developing apparatus.

Now, a description will be provided in more detail of the developing apparatus 4 according to this embodiment with reference to FIGS. 2 and 3. Since the respective developing apparatuses 4*a*, 4*b*, 4*c*, and 4*d* that are used in the image forming apparatus main body according to this embodiment are identical in structure with each other, only one developing apparatus 4 will be described. In the following description, the developing apparatus 4 is a generic term used to refer to any one of the developing apparatuses 4*a*, 4*b*, 4*c*, and 4*d*.

Figure 13:
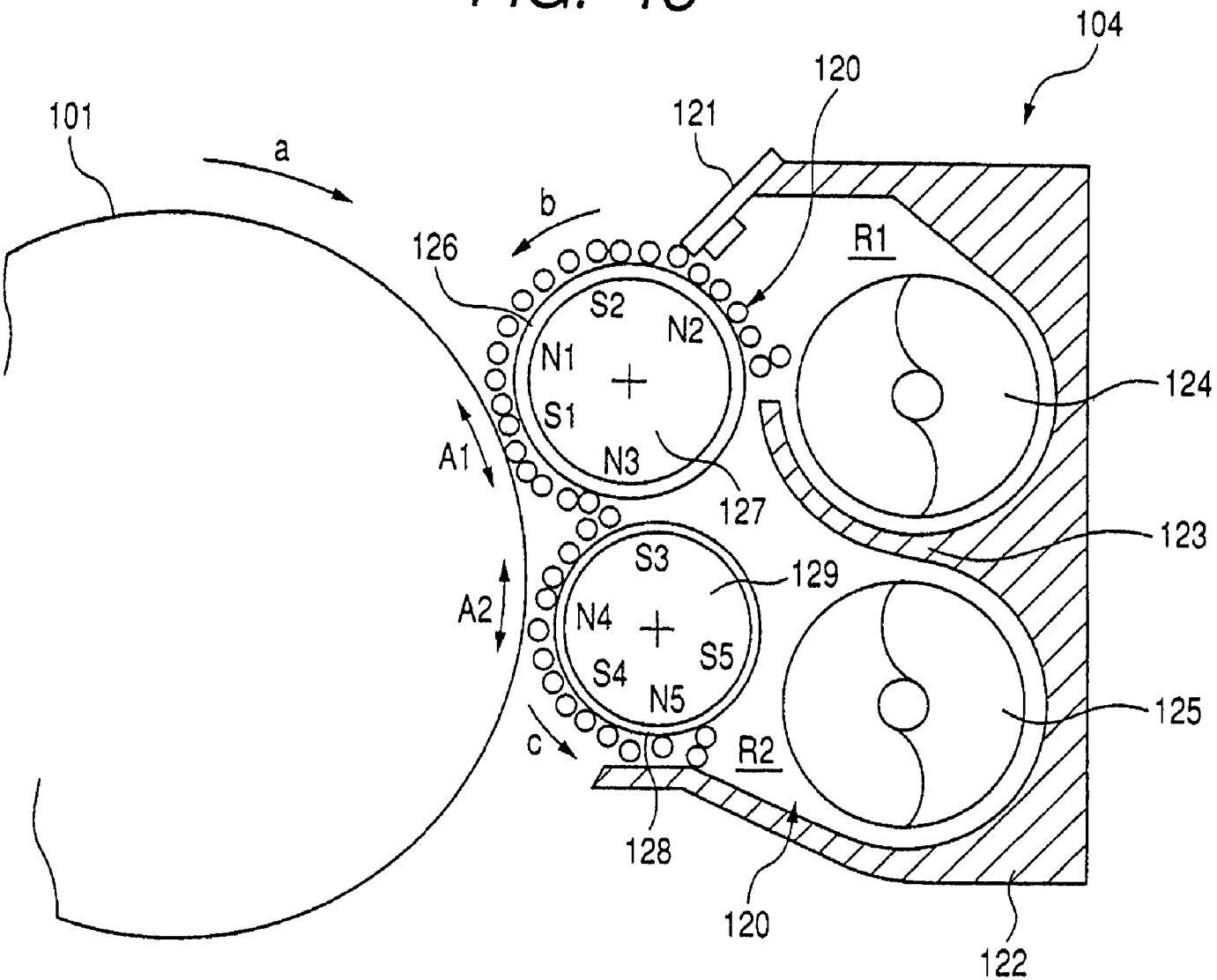
FIG. 13 is a diagram for explaining a conventional developing apparatus.
Figure 14:
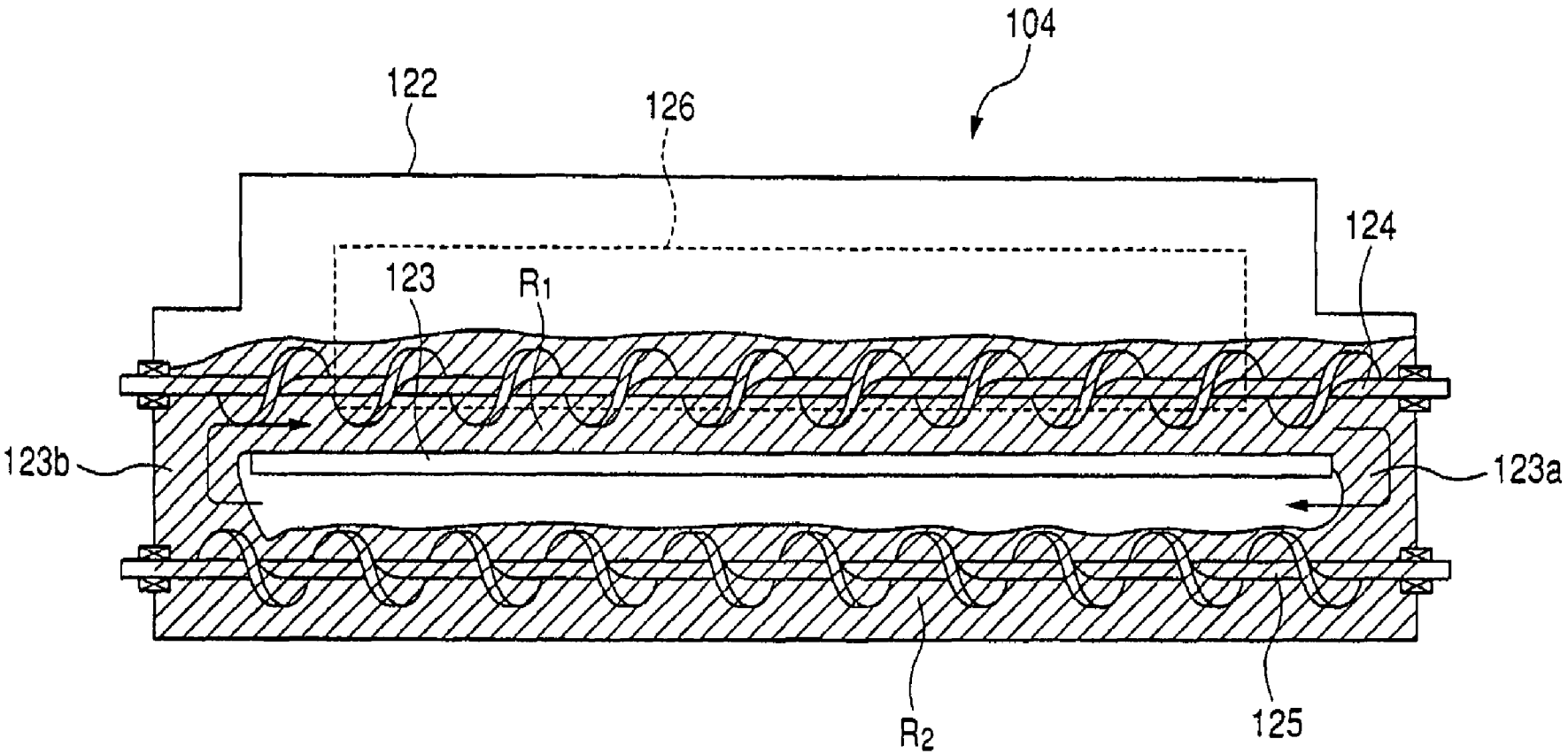
FIG. 14 is a lateral cross-sectional view schematically showing a structure of the conventional developing apparatus.
Figure 15A:
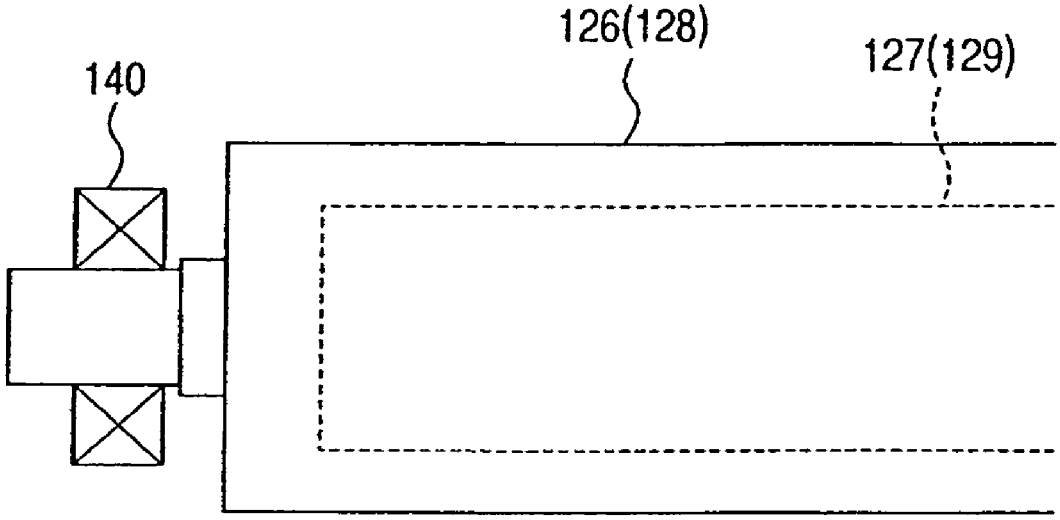
FIGS. 15A and 15B are lateral cross-sectional views for explaining a schematic structure in the vicinity of the end of the development sleeve in the conventional developing apparatus, respectively.
Figure 15B:
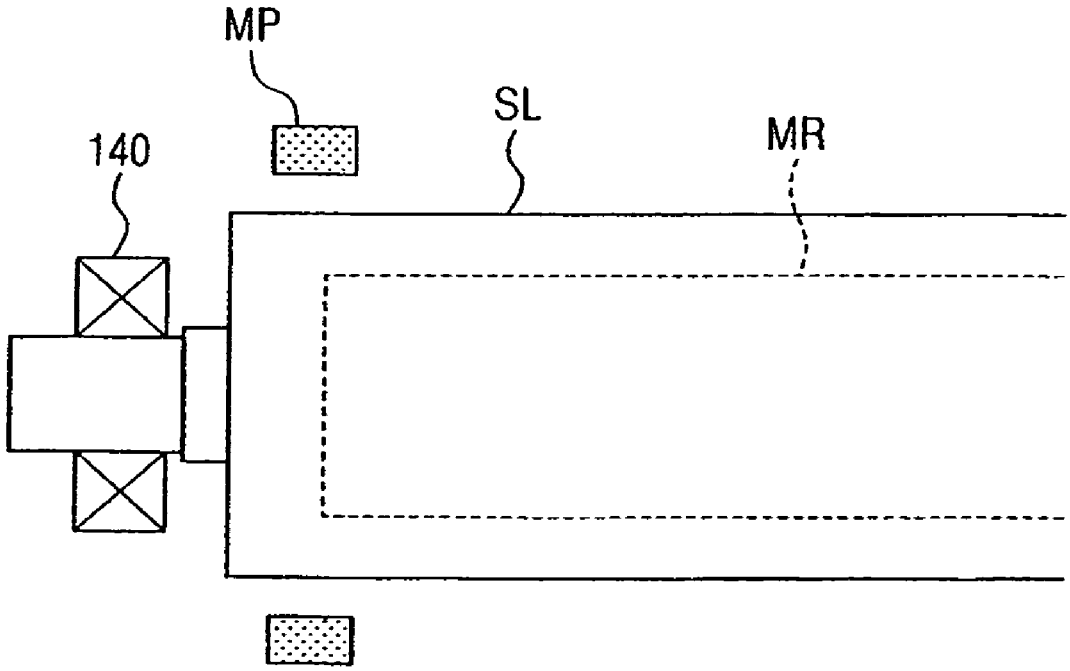

In this embodiment, the developing apparatus 4 is identical in structure with the developing apparatus of the multistage magnetic brush developing system having two developing sleeves as the developer carrying member which is described with reference to FIG. 13 in advance.

In other words, in this embodiment, the developing apparatus 4 has a developer container 22, and the interior of the developer container 22 is compartmented into a development chamber R1 and an agitation chamber R2 by a partition 23. On the other hand, a developer 20 is reserved in the development chamber R1 and the agitation chamber R2. In this embodiment, the developer is made of a two-component developer in which the toner particles and the magnetic carriers (that is, magnetic particles) are mixed together. The magnetic carriers used in this embodiment may be made of ferrite carriers or resin magnetic carriers made of a binder resin, magnetic metal oxide, and nonmagnetic metal oxide.

A transporting screw 24 is received in the development chamber R1, and transports the developer 20 to the developer container 22 along a longitudinal direction parallel to the photosensitive drum 1 by rotary driving. A transporting screw 25 is received within the agitation chamber R2, and transports the developer 20 to the developer container 22 along a longitudinal direction parallel to the photosensitive drum 1 by rotary driving. The developer transporting direction of the transporting screw 25 is opposite to that of the transporting screw 24.

Openings 23*a* and 23*b* are defined in the partition 23 at a backside and a front side of FIG. 2 as shown in FIG. 3. The developer 20 that has been transported by the transporting screw 24 is delivered to the transporting screw 25 from the opening 23*a*, and the developer 20 that has been transported by the transporting screw 25 is delivered to the transporting screw 24 from the opening 23*b*.

An opening portion is defined at a portion of the developer container 22 in vicinity of the photosensitive drum 1, and two developer carrying members consisting of a first development sleeve (i.e., first developer carrying member) 26 and a second development sleeve (i.e., second developer carrying member) 28 which are made of a non-magnetic material are disposed in the opening portion. In this embodiment, the first and second development sleeves 26 and 28 are made of aluminum, nonmagnetic stainless steel, or other materials and appropriate irregularities are formed on the surfaces of the first and second development sleeves 26 and 28.

Also, the upstream development sleeve 26 that is the first developer carrying member is disposed opposite to the photosensitive drum 1 to define a development area A1, and the downstream development sleeve 28 that is the second developer carrying member is disposed opposite to the photosensitive drum 1 to define a development area A2.

Of the two first and second developer carrying members, the upstream development sleeve 26, which is disposed opposite to the photosensitive drum 1 at an upstream side in a rotating direction "a" of the photosensitive drum 1, rotates in a direction indicated by an arrow "b" (i.e., in a direction opposite to the rotating direction "a" of the photosensitive drum 1).

Also, in this embodiment, a blade-shaped developer regulating member (i.e., layer thickness regulating blade) 21 is disposed at a top end of the opening portion of the developer container 22 upstream of the development area A1 in the rotating direction of the development sleeve 26. The development sleeve 26 carries and transports the developer 20 to the upstream development area A1 after the retained developer is regulated to an appropriate developer layer thickness by the layer thickness regulating blade 21.

A roller-shaped first magnetic field generating means 27 is fixed within the upstream development sleeve 26. The first magnet roller 27 has a development magnetic pole S1 that faces the first development area A1. The magnetic brush of the developer is produced due to the development magnetic field that is produced in the first development area A1 by the development magnetic pole S1, and the magnetic brush is brought into contact with the photosensitive drum 1 in the direction indicated by the arrow "a" in the first development area A1 to develop the electrostatic latent image in the first development area A1. In this situation, the toner that adheres to the magnetic brush and the toner that adheres to the surface of the development sleeve are also transferred to an image area of the electrostatic latent image and then developed. In this embodiment, the first magnet roller 27 has N1, S2, N2 (i.e., fourth magnetic pole), and N3 (i.e., first magnetic pole) poles in addition to the above-mentioned development magnetic pole S1. Among those magnetic poles, the N2 pole and the N3 pole are identical in polarity with each other and adjacent to each other to develop a repulsive magnetic field, to thereby produce a barrier with respect to the developer.

As described above, the downstream development sleeve 28 that is the second developer carrying member is disposed below the upstream development sleeve 26 and in an area that substantially faces both of the upstream development sleeve 26 and the photosensitive drum 1. The downstream development sleeve 28 is located rotatably in a direction indicated by an arrow "c" (i.e., the same direction as that of the first development sleeve 26). As described above, the downstream development sleeve 28 is also made of a nonmagnetic material, as with the upstream development sleeve 26, and a roller-shaped second magnet roller 29 that is a second magnetic field generating means is located in a non-rotating state in the interior of the second development sleeve 28. The second magnet roller 29 has five poles consisting of magnetic poles S3 (i.e., second magnetic pole), N4, S4, N5, and S5 (i.e., third magnetic pole). Among those poles, the magnetic brush on the N4 pole comes in contact with the photosensitive drum 1 in the second development area A2, and further conducts a second development on the photosensitive drum 1 that has passed through the first development area A1.

Also, the S3 pole and the S5 pole are identical in polarity with each other, a repulsive magnetic field is developed between the S3 pole and the S5 pole to create a barrier with respect to the developer. Among those poles, the S3 pole faces the N3 pole of the first magnet roller 27 that is included in the upstream development sleeve 26 in the vicinity of a position closest to both of those sleeves.

Figure 4:
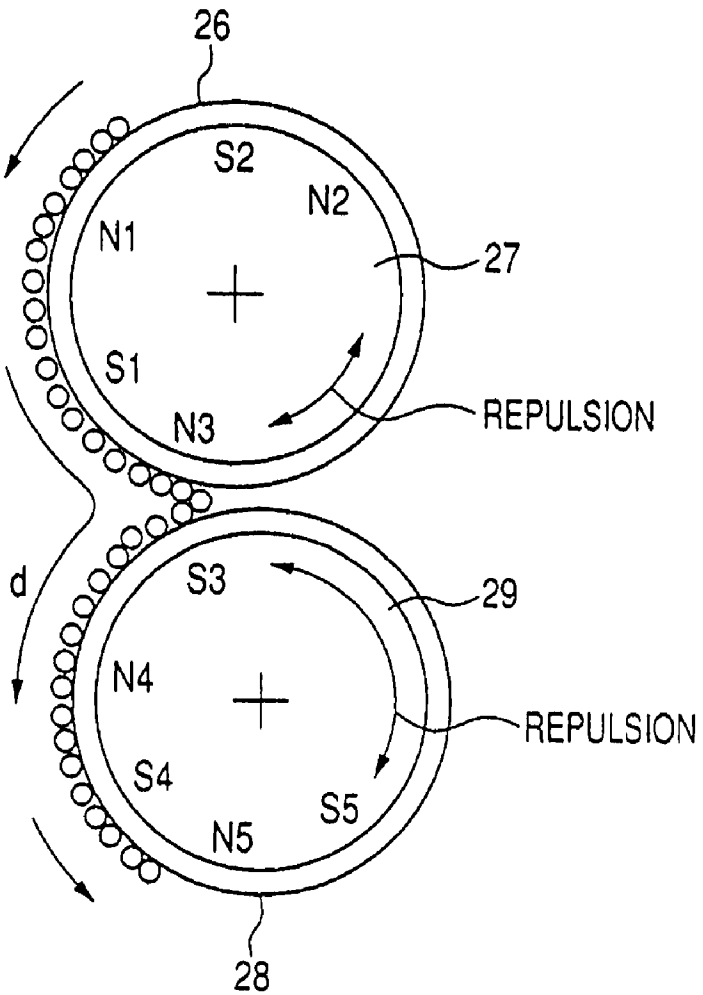
FIG. 4 is a diagram for explaining a flow of a developer that is transported on development sleeves of the developing apparatus.

Hereinafter, a flow of the developer will be described with reference to an enlarged diagram (i.e., FIG. 4) showing the vicinity of the upstream development sleeve 26 and the downstream development sleeve 28.

A repulsive magnetic field is provided between the N3 pole and the N2 pole of the upstream development sleeve 26, and a repulsive magnetic field is also provided between the S3 pole and the S5 pole of the upstream development sleeve 28. Therefore, the developer that has been transported on the first development sleeve 26 and has passed the development area reaches the N3 pole, is capable of passing through the closest position of both the sleeves due to the repulsive magnetic field. The developer is moved to the downstream development sleeve 28 side in the developer delivering area according to a line of magnetic force that extends from the N3 pole to the S3 pole as indicated by an arrow "d". The developer is then transported on the downstream development sleeve 28 up to the transporting screw 25 within the agitation chamber R2.

According to this embodiment, the downstream development sleeve 28 is disposed below the upstream development sleeve 26 with the result that the developer is transported in the stated order of N2→S2→N1→S1→N3 on the upstream development sleeve 26. Thereafter, the developer on the upstream development sleeve 26 is blocked by the repulsive magnetic field of both the sleeves 26 and 28, and then moved to the downstream development sleeve 28. Then, the developer is transported on the downstream development sleeve 28 in the stated order of S3→N4→S4→N5→S5, blocked by the repulsive magnetic field at the S5 pole, and peeled off to the agitation chamber R2.

It is unnecessary that N3 and S3 that are delivery poles perfectly face each other. It is possible that the developer is smoothly delivered when the delivery poles substantially face each other within a range which is shifted by 45° from a state in which those delivery poles perfectly face each other.

Figure 5:
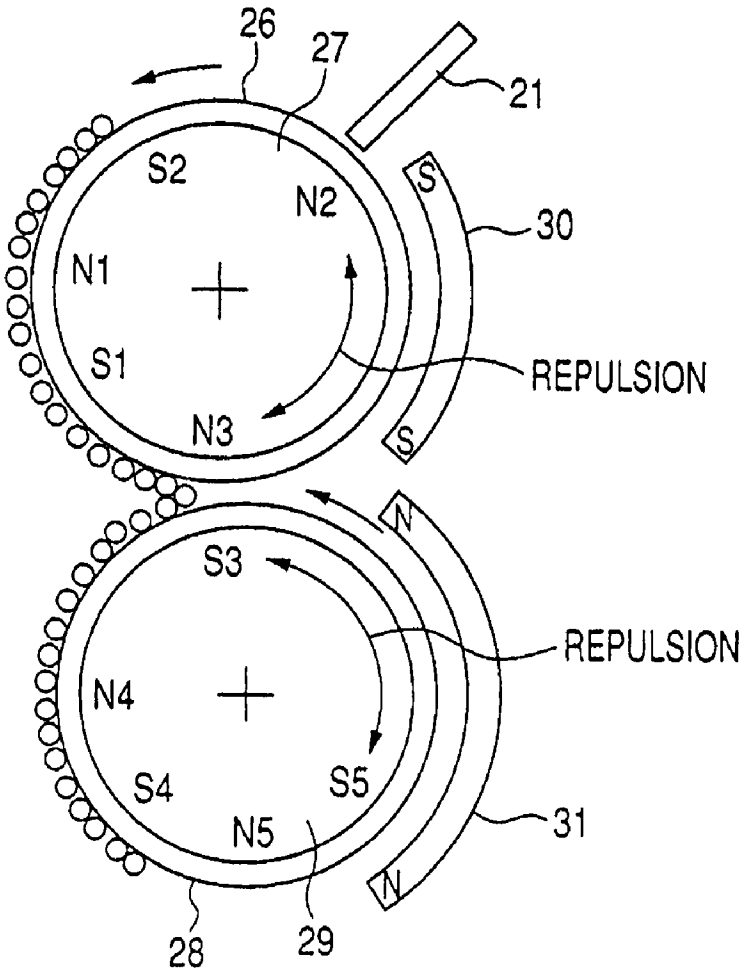
FIG. 5 is a diagram for explaining a developing apparatus in a comparative example.

Now, the magnetic seal portion in this embodiment will be described in more detail with reference to FIGS. 5 and 6.

A magnet member, that is, plate-shaped magnets (i.e., magnet plates) 30 and 31 in this embodiment are disposed as the magnetic seal members in vicinity of the development sleeves 26 and 28 along the development sleeves 26 and 28 in a non-contact state. With this structure, a magnetic brush that is formed by the developer is produced between the magnet rollers 27 and 29 within the development sleeves 26 and 28 and the magnets 30 and 31 that are the magnetic seal members, thereby making it possible to prevent the developer from leaking.

In this example, the magnets, that is, the magnet plates each having one surface of an N pole and its back surface of an S pole are used as the magnetic seal members 30 and 31. Also, as shown in FIG. 5 as a comparative example, the magnetic seal members 30 and 31 have surfaces that are different in polarity from the poles (i.e., N2 and N3, and S3 and S5) that produce the repulsive magnetic fields of the magnet rollers 27 and 29 within the upstream and downstream development sleeves 26 and 28 as the surfaces of the development sleeve sides. In this case, the lines of magnetic force is extended between the magnet rollers 27 and 29 within the development sleeves 26 and 28 and the magnets that are magnetic seal members 30 and 31 to form the magnetic brush formed by the developer, thereby making it possible to prevent the developer from leaking.

As described in Description of The Related Art, the above is excellent in preventing leakage of the developer to the end direction of the development sleeves 26 and 28. However, the developer is liable to leak from a space between the upstream development sleeve 26 and the downstream development sleeve 28 on the ends of the development. The reasons will be described below.

Of the S3 pole and the S5 pole that produce the repulsive magnetic field of the downstream development sleeve 28, the S3 pole also serves as a delivery pole that receives the developer from the upstream development sleeve 26. As a result, because the upstream development sleeve 26 exists at an opposing portion of the S3 pole of the delivery pole, the magnetic seal member 31 is capable of extending the magnetic seal member only up to the middle of the repulsive magnetic field as shown in FIG. 5. For that reason, the S3 pole of the delivery pole does not face the magnetic seal member 31. However, the magnetic seal member 31 and the S3 pole of the delivery pole are different in polarity from each other, and the line of magnetic force is produced between the magnetic seal member 31 and the S3 pole of the delivery pole. For that reason, a part of the developer that has been caught by the magnetic seal member 31 is attracted to the S3 pole of the delivery pole, and then moved. The developer that has been moved to the S3 pole by the magnetic seal member 31 at the end of the development sleeve is leaked in the direction toward the end of the development sleeve 28 because there is no magnetic seal member 31 at a side opposite to the S3 pole. The leaked developer is transported with the rotation of the development sleeve 28, and then leaked from the space between the upstream and downstream development sleeves 26 and 28.

In order to prevent the developer from leaking from the space between the upstream and downstream development sleeves 26 and 28 as described above, it is necessary that the line of magnetic force be prevented from being created between the magnetic seal member 31 of the downstream development sleeve 28 and the delivery pole S3. In order to achieve this, in the case of using a magnet plate having one surface of N pole and its back surface of S pole as the magnetic seal member 31, as shown in FIG. 6, it is necessary that an S pole that is identical in polarity with the delivery pole S3 be placed at an opposing surface of the development sleeve.

Figure 6:
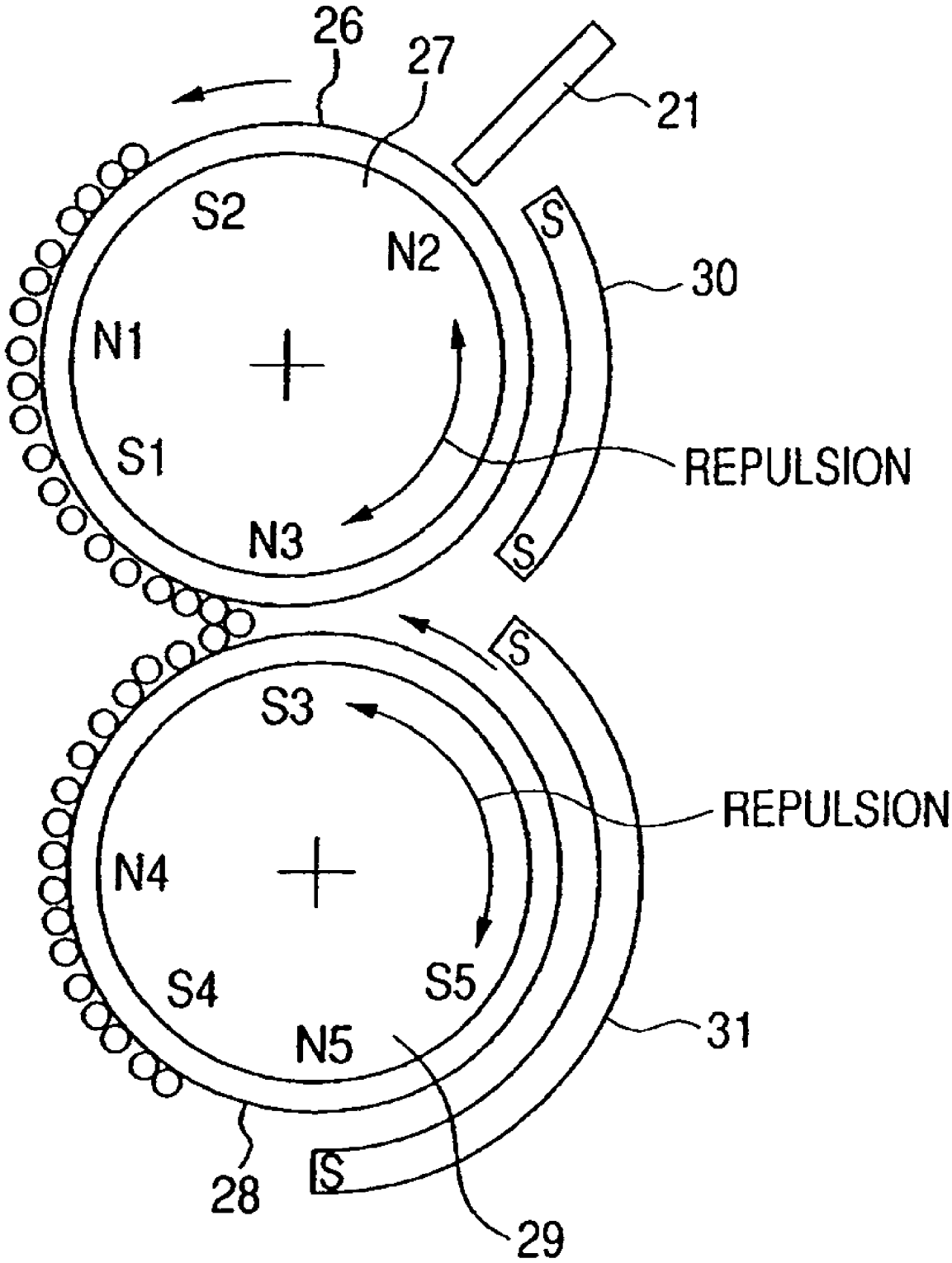
FIG. 6 is a diagram for explaining the developing apparatus according to the embodiment of the present invention.

However, in the structure shown in FIG. 6, because the S pole surface that is identical in polarity with the S3 pole and the S5 pole which produce the repulsive magnetic field of the downstream development sleeve 28 faces the downstream development sleeve 28 as the magnetic seal member 31, the repulsive magnetic field is also provided between the S3 pole and the magnetic seal member 31, or the S5 pole and the magnetic seal member 31. For that reason, there arises a problem in sealing property of the magnetic seal member 31 in the longitudinal direction of the development sleeve, depending on relationships among the respective magnetic poles.

In order to solve the above-mentioned problem, in this embodiment, a magnetizable plate 32 that surrounds the peripheral surface of the end of the development sleeve 28 in a non-contact fashion is fitted to the inner surface of the side wall 22*a* at each side of the developer container 22. The same structure can be applied to the upstream development sleeve 26.

First, the downstream development sleeve 28 will be described. The upstream development sleeve 26 will be described later.

Figure 8A:
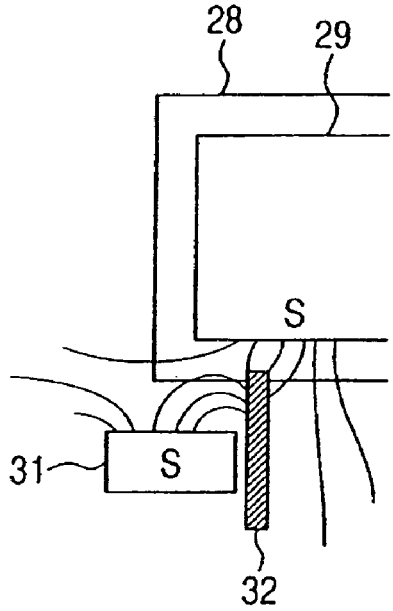
FIGS. 8A, 8B, and 8C are diagrams for explaining lines of magnetic force in the vicinity of a magnetic seal member and a magnetizable plate, respectively.
Figure 8B:
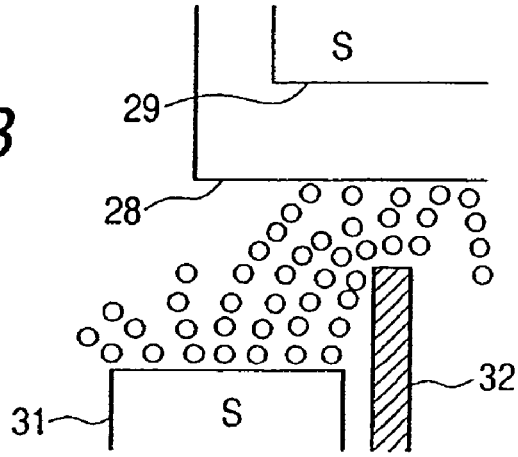

The magnetizable plate 32 that is disposed at the end of the downstream development sleeve 28 is magnetized by the magnetic force of the magnet roller 29 within the development sleeve 28 and the magnetic force of the magnet 31 that is a magnetic seal member. As a result, a magnetic circuit is formed between the magnetizable plate 32 and the magnet roller 29, and the magnetic field is concentrated on the fore-end of the magnetizable plate 32 at the downstream development sleeve 28 side as indicated by the lines of magnetic force in FIG. 8A.

The magnetic field allows a dense magnetic brush to be produced in gaps between the magnetizable plate 32 and the downstream development sleeve 28, and the magnetizable plate 32 and the magnetic seal member 31 by the developer. The magnetic brush functions as an end seal. The magnetic brush blocks the developer that is transported from the interior of the developer container 22 along the surface of the development sleeve 28 due to reciprocating circulation within the developer container 22 between the magnetizable plate 32 and the development sleeve 29.

Figure 8C:
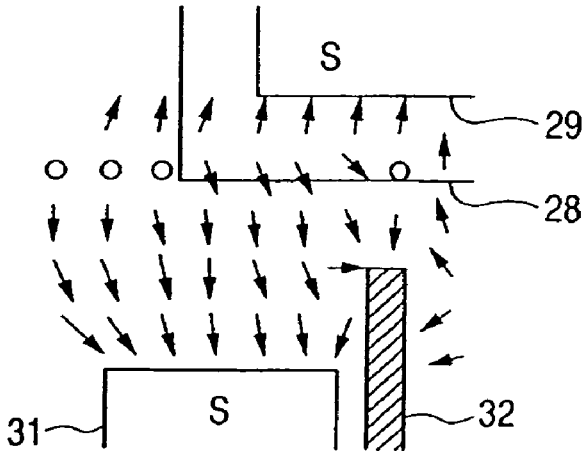

Further, FIG. 8C schematically shows a force that is exerted on the magnetic carrier in an area that is surrounded by the magnetizable plate 31 that is a magnetic seal member and the development sleeve 28.

Figure 16A:
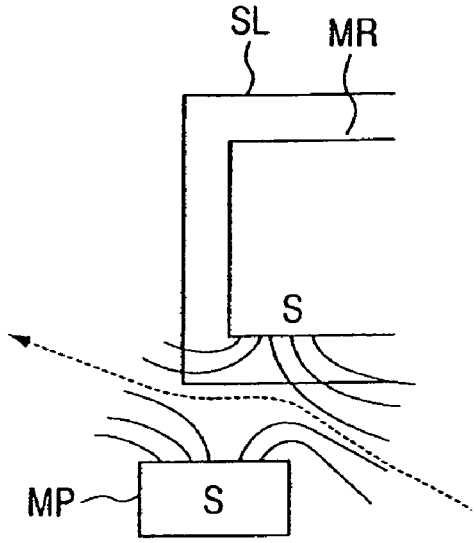
FIGS. 16A, 16B, and 16C are diagrams for explaining lines of magnetic force in the vicinity of a magnetic seal member of the conventional developing apparatus, respectively.
Figure 16B:
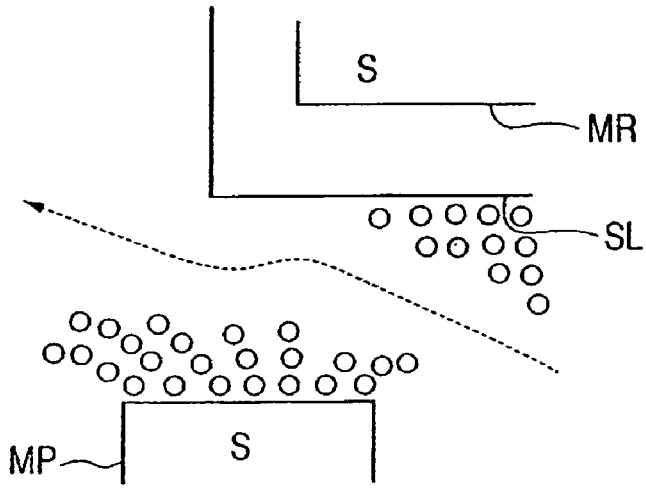
Figure 16C:
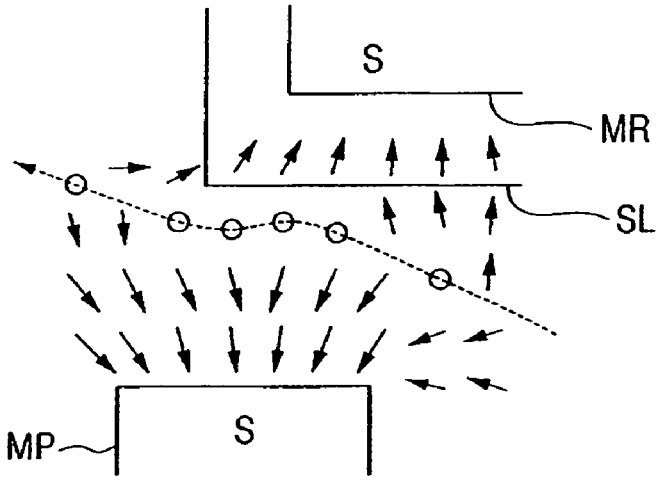
Figure 17A:
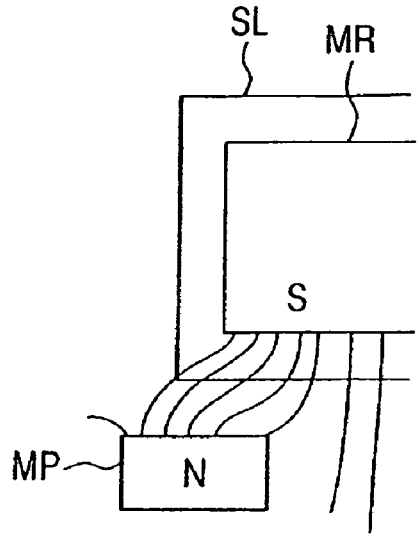
FIGS. 17A, 17B, and 17C are diagrams for explaining lines of magnetic force in the vicinity of the magnetic seal member of the conventional developing apparatus, respectively.
Figure 17B:
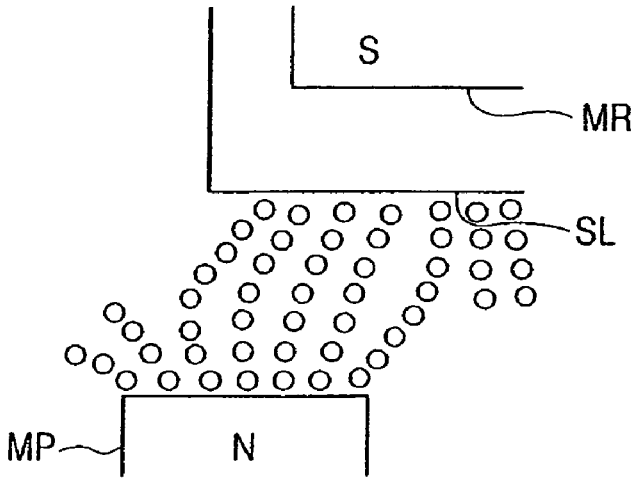
Figure 17C:
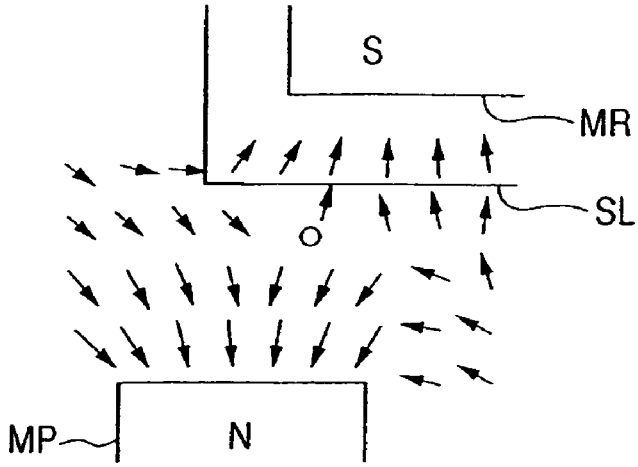
Figure 18:
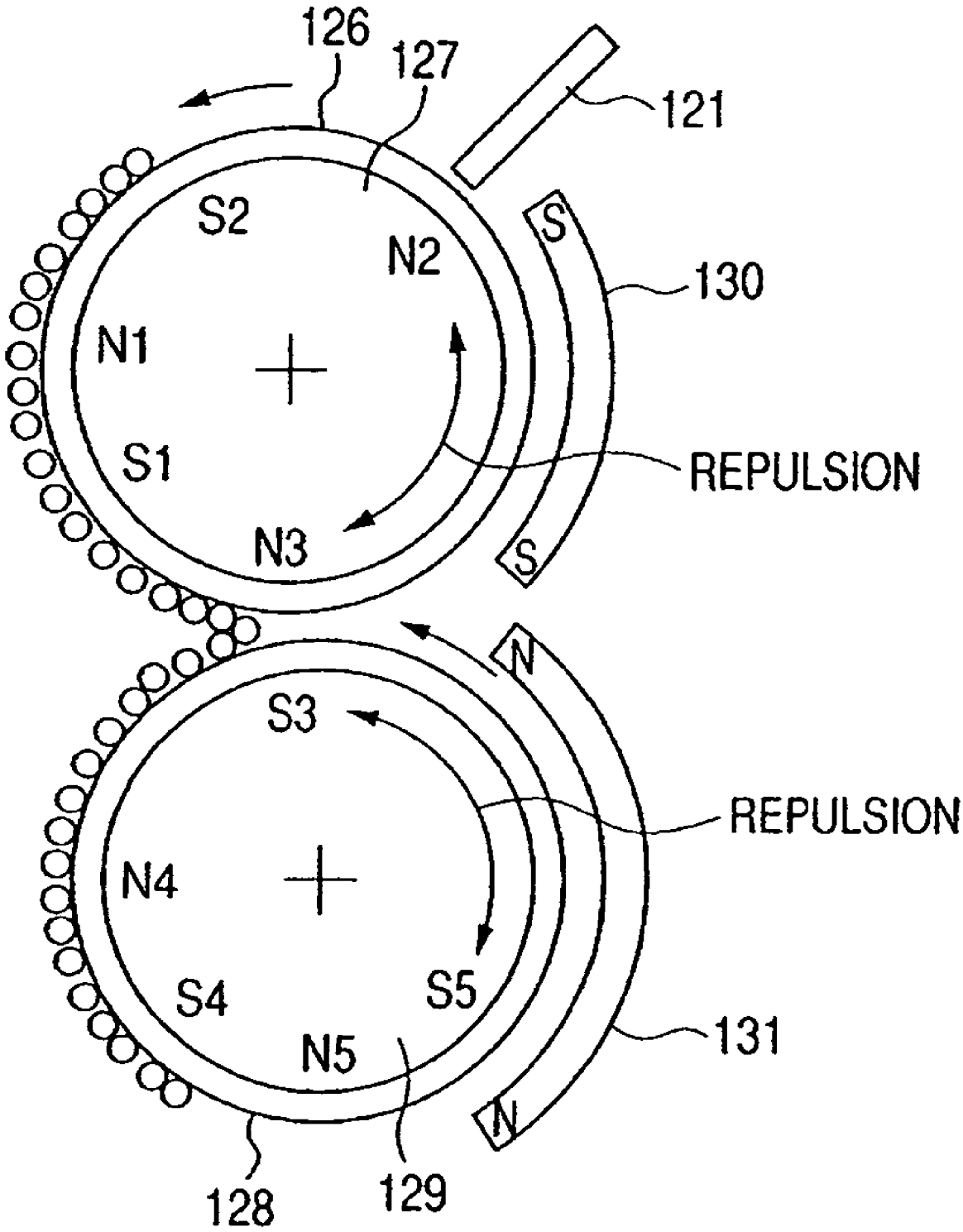
FIG. 18 is a diagram for explaining a flow of the developer that is transported on the development sleeve of the conventional developing apparatus.

As in FIGS. 16C and 17C in the conventional art, arrows in FIG. 8C indicate directions of forces at those positions, and the lengths of the arrows express the magnitudes of the forces. In the case where the magnets are identical in polarity with each other while facing each other, areas in which there is substantially no force that is exerted on the magnetic carrier (i.e., areas where the direction of the magnetic force that is exerted on the magnet is inverted) continuously exist between the magnets (refer to FIG. 16C in the conventional art).

However, when the magnetizable plate 32 is effectively arranged as in this embodiment, it is possible that areas (indicated by marks ○ in FIG. 8C) in which there is substantially no force that is exerted on the magnetic carrier are not allowed to continuously exist between the magnets.

As described above, in this embodiment, since the magnetizable plate 32 is arranged, the areas having substantially no force that is exerted on the magnetic carrier, that is, the areas in which the magnetic force that is exerted on the magnetic carrier is small are not allowed to continuously exist between the magnetic seal member 31, and the development sleeve 28 and the magnetizable plate 32 in the longitudinal direction, respectively. With the above-mentioned structure, in this embodiment, the magnetic carrier in the areas that are surrounded by the magnetic seal member 31, and the development sleeve 28 and the magnetizable plate 32 is always attracted to the magnetic seal member 31 and the magnet roller 29 within the development sleeve 28 during a process in which the magnetic carrier move in the direction of the end of the development sleeve 28. As a result, it is difficult that the developer flows out of the development area, thereby making it possible to exercise the excellent sealing property.

Figure 7:
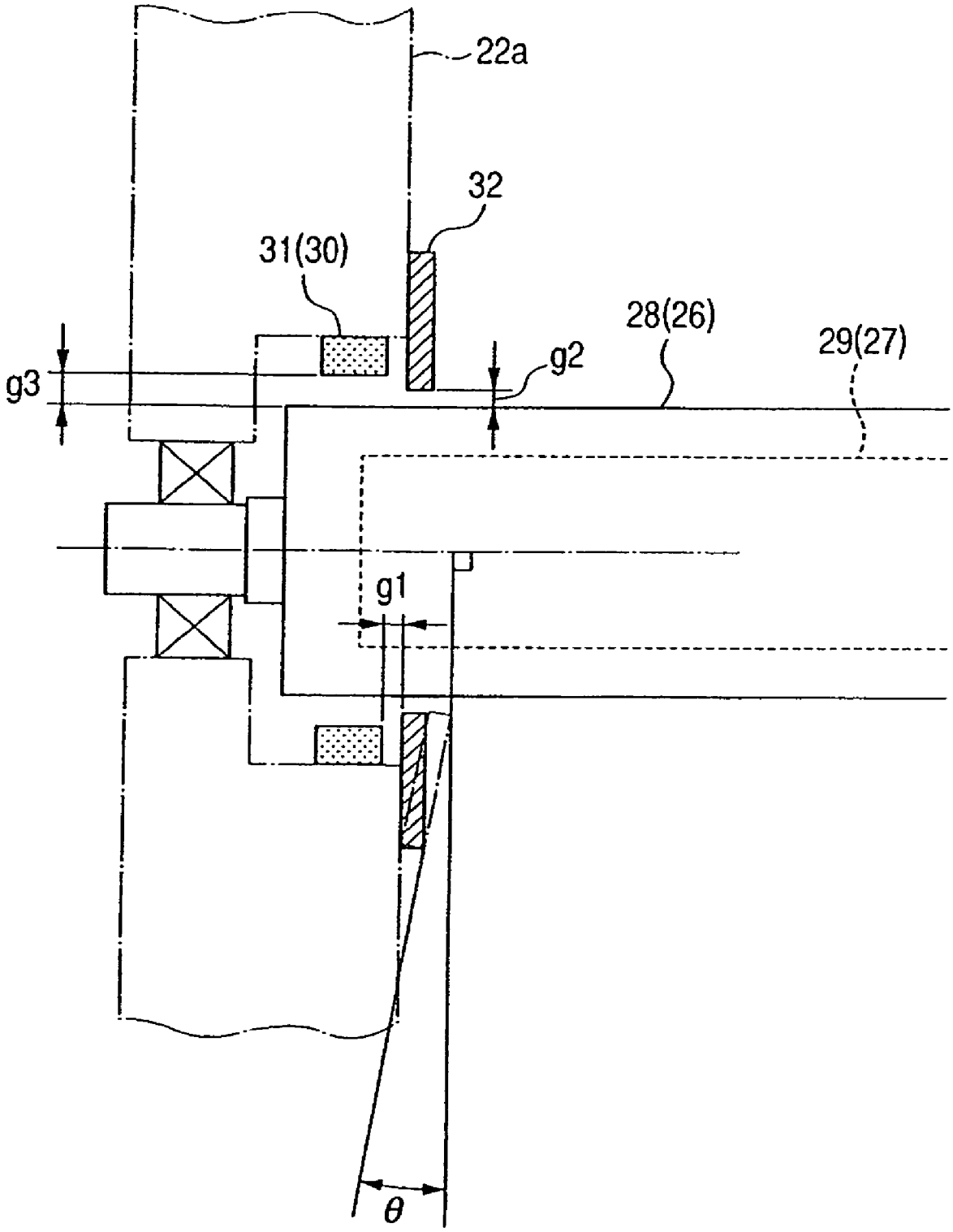
FIG. 7 is a lateral cross-sectional view showing a portion in the vicinity of an end of the development sleeve for explaining the developing apparatus according to the embodiment of the present invention.

In this embodiment, as shown in FIG. 7, the magnetizable plate 32 is disposed apart from the magnetic seal member 31 toward the developer container 22 side at a gap (g1) of 0.3 mm. Also, the magnetizable plate 32 is so disposed as to surround the development sleeve 28 with a constant gap (g2) of 0.5 mm in a non-contact fashion, as with the magnetic seal member 31. A gap (g3) between the surface of the development sleeve 28 and the magnetic seal member 31 is 1 mm. The magnetic seal member 31 as used is 60 mT (milli Tesla).

The arrangement of the magnetizable plate 32 is not limited to the above-mentioned conditions. In the area that is surrounded by the magnetic seal member 31 and the development sleeve 28, it is possible to prevent the leakage so far as the magnetizable plate 32 is disposed such that areas in which there is substantially no force that is exerted on the magnetic carrier are not allowed to continuously exist along the longitudinal direction of the development sleeve.

A force (i.e., magnetic force) F that is exerted on the magnetic carrier (i.e., magnetic particles) that is a magnetic material can be measured as follows.

The magnetic force F is represented by the following expression with an external magnetic field (i.e., magnetic flux density) as B. The above description is provided on the basis of two dimensions formed of the longitudinal direction of the development sleeve and the direction perpendicular to the surface of the development sleeve. However, in fact, because it is necessary to take the peripheral direction of the development sleeve into consideration, it is necessary to measure the magnetic force three-dimensionally. $F=(m\cdot\nabla)B$ where $F=(Fx, Fy, Fz)$ In this situation, the magnitude of the magnetic force is represented as follows.

$$|F|=(Fx^2+Fy^2+Fz^2)^{1/2}$$

In this example, since the magnetic bipolar moment "m" in the magnetic carrier in the above-mentioned expression generally has the magnetization that is in proportion to the external magnetic field, the magnetic bipolar moment "m" is represented as follows.

$$m=|A|B$$

$$F=|A|(B\cdot\nabla)B$$

$$=-|A|\nabla B^2$$

$$Fx(x, y, z)=-|A|\{B^2(x, y, z)-B^2(x+\Delta x, y, z)\}/\Delta x$$

$$Fy(x, y, z)=-|A|\{B^2(x, y, z)-B^2(x, y+\Delta y, z)\}/\Delta y$$

$$Fz(x, y, z)=-|A|\{B^2(x, y, z)-B^2(x, y, z+\Delta z)\}/\Delta z$$

where |A| is a function including the magnetic permeability, and represented as follows in the case the carrier is spherical.

$$|A|=(4\pi/\mu_0)\times(\mu-1)/(\mu-2)\times r^3$$

where r is the radius of carrier, μ is the relative magnetic permeability of carrier, and $\mu_0$ is a space permeability.

It is understood from the above-mentioned fact that in the case where the intensity of magnetic field, $|B|(=\{Bx^2+By^2+Bz^2\}^{1/2}$, changes, the magnetic force is developed from a point at which the magnetic flux density is smaller toward a direction along which the magnetic flux density is larger. Conversely, no magnetic force is exerted in a direction along which no intensity of magnetic field |B| changes.

Therefore, when the intensity of the magnetic field (i.e., magnetic flux density) is continuously measured in an area surrounded by the magnetic seal member 31 and the development sleeve 28, it is possible to obtain the magnitude and the direction of the magnetic force F from its difference on the basis of the above-mentioned expressions.

It is possible to measure the intensity of external magnetic field (i.e., magnetic flux density) |B| by a gaussmeter (i.e., teslameter) on the market. The present inventors have employed the gaussmeter model 640 manufactured by FW Bell. Because it is possible to measure the magnetic flux density at a probe fore-end in one direction by the gaussmeter, the magnetic flux densities (herein, Bx, By, Bz) in the three directions are measured by using probes of the three kinds of x-axis, y-axis, and z-axis, and the intensity of magnetic field is derived from the measured results. In this way, the measurement of the magnetic flux density is repeated to derive the distribution of the intensity of the magnetic field, and the magnitude and direction of the magnetic force F are obtained on the basis of the measured results. The measurement is conducted under the conditions where Δx, Δy, and Δz in measurement are set to 250 μm. The distribution of magnetic field can be grasped more precisely as Δx, Δy, and Δz are made smaller. However, there arises a problem that it takes time to conduct measurement. On the other hand, the precise distribution of a magnetic field cannot be grasped as Δx, Δy, and Δz are made larger. It is proper that Δx, Δy, and Δz are about 100 to 300 μm.

Since the members other than the magnetic member do not affect the measurement, the measurement is conducted by only the magnet roller, the magnet plate, and the magnetizable plate. In other words, the measurement is conducted by reproducing the actual arrangement in a state where there is no development sleeve. As a result, not only the magnetic flux density can be measured in a narrower area, but also the magnetic force in the interior of the development sleeve can be also grasped. In this situation, the probe is fixed to an xyz stage, and the measurement is continuously conducted while the xyz stage is being moved.

The magnetic force that is exerted on the carrier is obtained on the basis of the above-mentioned measurement results and the above-mentioned expression.

For example, in the case of the carrier that approximates a sphere that is 17.5 μm in radius, 12 in relative magnetic permeability μ, and 4.8 g/cm$^3$ in true specific gravity ρ, because the space permeability is $4\pi\times10^{-7}$, $|A|=2.46\times10^{-6}$ m$^3$ is satisfied, and the magnetic force is found on the basis of the measured value of the square $B^2$ of the intensity of the magnetic field. $Fx=|A|\Delta Bx^2/\Delta x$ $$=(2.5\times10^{-6})/(2.5\times10^{-4})\times\Delta Bx^2$$

$$=10^{-2}\times\Delta Bx^2\ (N)$$

$$=10^{-2}\times(B_x^2-B_{x+}\Delta x^2)\ (N)$$

Since the intensity of magnetic field is a difference in the square of the intensity of magnetic field, the magnetic force becomes larger as the intensity of magnetic field is larger, or as the difference is larger. In the case where the intensity of the magnetic field is smaller, the magnetic force is small even if the difference is relatively large. This coincides with the actual phenomenon.

When the magnetic force that is exerted on the carrier which has been obtained by the above-mentioned expression is small, the carrier is low in the magnetic binding force in the magnetic seal portion, and the possibility that the leakage occurs is high in the development sleeve end in the case where areas in which the magnetic force is small continuously exist in the thrust direction of the development sleeve.

According to a study made by inventors of the present invention, there is a case in which the binding force is small, and the leakage starts as Fx becomes smaller than $1\times10^{-6}$ (N).

For example, in the case where the intensity of magnetic field changes from 100 mT to 90 mT, the following expression is satisfied.

$$F=10^{-2}\times\{(100\times10^{-3})^2-(90\times10^{-3})^2\}=1.9\times10^{-5}$$

In this case, the magnetic force of some degree remains. On the other hand, in the case where the intensity of the magnetic field changes from 12 mT to 2 mT, a difference in the intensity of magnetic field is 10 mT which is identical with that in the above-mentioned example. However, the following expression is satisfied.

$$F=10^{-2}\times(12\times10^{-3})^2-(2\times10^{-3})^2\}=1.4\times10^{-6}$$

Thus, the magnetic force becomes smaller. This is because the intensity per se of the magnetic field becomes smaller. Now, let us consider a case in which the difference in the intensity of the magnetic field is further reduced to 5 mT, that is, a case in which the intensity of the magnetic field changes from 12 mT to 7 mT. As a result, the following expression is satisfied.

$$F=10^{-2}\times\{(12\times10^{-3})^2-(7\times10^{-3})^2\}=9.5\times10^{-7}$$

That is, the magnetic force that is exerted on the carrier is further reduced and becomes smaller than $1\times10^{-6}$ (N), as a result of which the leakage is liable to occur.

The above-mentioned calculation is conducted one-dimensionally, but in fact, it is necessary to conduct calculation three-dimensionally. Also, in order to conduct accurate measurement, it is necessary that Δx, Δy, and Δz are reduced as much as possible. In fact, there is a limit of a measuring device per se.

Under the above-mentioned circumstances, in the case where it is assumed from the distribution of the measured magnetic force that the areas in which the magnetic force is lower than $1\times10^{-6}$ (N) continuously exist in the thrust (i.e., longitudinal) direction of the development sleeve, there is the possibility that the leakage occurs. Therefore, in order to prevent the leakage in the thrust direction, it is necessary that the areas in which the magnetic force is equal to or higher than $1\times10^{-6}$ (N) exist in contact with both of the surface of the magnetic seal member 31 and the surface of the development sleeve 28. With the above-mentioned structure, the areas in which the magnetic force is lower than $1\times10^{-6}$ (N) cannot continuously exist in the thrust (i.e., longitudinal) direction of the development sleeve. In other words, the areas having a capability of trapping the magnetic particles continuously exist between the surface of the magnetic seal member 31 and the surface of the development sleeve 28, thereby making it possible to ensure the sealing property in the longitudinal direction.

With the above-mentioned structure, it is possible to prevent the developer from leaking from a space between the upstream and downstream development sleeves while ensuring the magnetic sealing property at the ends of the developing sleeves.

In this embodiment, as shown in FIG. 6, the magnet 31 that is the magnetic seal member is extended up to the opposing portion of the N5 pole which is positioned further upstream of the S5 pole that produces the repulsive magnetic field in the sleeve rotating direction. As a result, since the magnetic seal member 31 is different in polarity from the N5 pole and faces the N5 pole, the magnetic seal property can be more positively ensured. Also, when there exist the portions that are different in polarity from each other while facing each other, the lines of magnetic force are extended directly between the magnet plate 31 and the magnet roller 29 within the development sleeve at that position. As a result, the developer that has been magnetically sealed is smoothly returned to the development sleeve side, that is, the interior of the developer container. From the above-mentioned viewpoint, it is important to provide one or more areas in which members different in polarity face each other for the purpose of preventing the developer from being reserved in the magnetic seal portion.

The above description is mainly provided of the downstream development sleeve 28. The following description will be provided of the upstream development sleeve 26.

In this embodiment, in the case of the downstream development sleeve 28, a magnet plate having one surface of N pole as the magnetic seal member 31 and its back surface of S pole is used as the magnetic seal member 31. In this case, as described above, when a surface that is different in polarity from the poles (S3 and S5) that produce the repulsive magnetic field of the magnet roller 29 within the downstream development sleeve 28 is a surface at the development sleeve side, the developer is leaked from a space between the upstream and downstream development sleeves 26 and 28 at the ends of the development sleeves.

However, in the upstream development sleeve 26, a surface that is different in polarity from the poles (N2 and N3) that produce the repulsive magnetic field of the magnet roller 27 within the upstream development sleeve 26 is a surface at the development sleeve side as the magnetic seal member 30. Even with the above-mentioned structure, the developer is not leaked from the space between the upstream and downstream development sleeves 26 and 28 at the ends of the development sleeves.

This is because as in the case of the downstream development sleeve 28, the lines of magnetic force are produced between the magnetic seal member 30 and the delivery pole N3 pole of the upstream development sleeve 26, and the developer is attracted to the delivery pole N3 pole. However, the rotating direction of the development sleeve at the position of the delivery pole N3 pole is different from that of the downstream development sleeve 28 at the S3 pole of the delivery pole, and rotates in a direction of transporting the developer within the developer container. Hence, the developer that has been leaked in the direction of the development sleeve end is also suitably collected within the developer container 22.

For that reason, in the upstream development sleeve 26, there arises no problem even when the surface that is different in polarity from the poles (N2 and N3) that produce the repulsive magnetic field of the magnet roller 27 within the upstream development sleeve 26 is a surface at the development sleeve side as the magnetic seal member 30.

Under the circumstances, in this embodiment, in the magnet plate 30 serving as the magnetic seal member of the development sleeve 26, a surface that is different in polarity from the repulsive magnetic field (N2 and N3) of the magnet roller 27, that is, the S pole is the surface at the development sleeve side. This is because the lines of magnetic force are positively developed between the magnet roller 27 and the magnetic seal member 30, thereby making it possible to more positively prevent the leakage.

In this embodiment, the magnetizable plate 32 that is used for the end seal of the downstream development sleeve 28 is extended up to the periphery of the upstream development sleeve 26. This is also to more positively prevent the leakage.

In this example, it is preferable that the magnetizable plate 32 is made of a ferromagnetic material such as iron, nickel, or cobalt, or an alloy of those materials. The thickness of the magnetizable plate 32 is set to about 0.2 to 1 mm. Those ferromagnetic materials are equal to or lower than 0.7 $J/m^2$ in (½)·(BH)max. B indicates a residual magnetic flux density, H indicates a coercive force, and (BH)max indicates the maximum energy product that is the maximum of the energy product (B×H).

As described above, the gap g2 between the magnetizable plates 32 and the development sleeves 26 and 28 is set to 0.5 mm in this embodiment. However, the present invention is not limited to this embodiment, and is appropriately set in a range of 0.3 to 2 mm.

The magnetizable plates 32 are formed of annular plates that are concentric with the development sleeves 26 and 28. However, the magnetizable plates 32 may not be always formed of the annular plates as long as a uniform gap g2 can be defined between the magnetizable plates 32 and the development sleeves 26 and 28, and diverse configurations can be applied. It is preferable that angles θ (refer to FIG. 7) defined between the plate surfaces of the magnetizable plates 26 and 28 and the surfaces orthogonal to the axes of the development sleeves 26 and 28 are equal to or lower than 20° from the viewpoint of more positively preventing the leakage of the developer.

The magnet plates 30 and 31 can be made of, for example, a rubber magnet (a magnet produced by mixing magnetic particles and rubber together) or a Nd-based (Neo-Dymium-based) magnet which has been magnetized with the magnetic flux density of 40 to 100 mT (milli Tesla). When the magnetic flux density is equal to or lower than 40 mT, it is difficult to produce the magnetic brush, leading to a problem on the magnetic sealing property. As described above, the rubber magnet having an appropriate elasticity is suitable for adhesion along the development sleeves. As described above, the distances g3 between the development sleeves 26 and 28 and the magnet plates 30 and 31 are set to 1 mm in this embodiment. However, the present invention is not limited to the above-mentioned structure. It is preferable that the distances g3 be in a range that enables the magnetic brush erected on at least the magnet plates to come into light contact with the outer peripheral surfaces of the development sleeves to lightly seal the outer peripheral surfaces of the development sleeves, and that the distances g3 be set to be in a range of 0.3 to 2.0 mm.

It is important that all of the magnetizable plates 32 and the magnet plates 30 and 31 are selected and disposed so that the distribution of the magnetic force becomes desirable.

In this embodiment, the case where the developer is the two-component developer containing the nonmagnetic toner and the magnetic carrier therein has been described. The two-component developer is applicable to all of cases in which the magnetic particles are contained in the developer such as a case using the magnetic toner or a case using the magnetic toner and the magnetic carrier. As described above, with the above-mentioned structure, the sealing of the ends of the development sleeves using the magnetic brush can be extremely effectively achieved in the developing apparatus having the plurality of development sleeves.

Second Embodiment

This embodiment is substantially identical in structure with the above-mentioned first embodiment. Hereinafter, structures different from those in the first embodiment will be mainly described.

In the first embodiment, in order to prevent the developer from leaking from a space between the upstream and downstream development sleeves 26 and 28, the magnet 31 is disposed such that the same pole surface as that of the S3 pole of the delivery pole of the downstream development sleeve 28 is the development sleeve surface. However, in fact, it is unnecessary to make all surfaces identical in polarity with each other.

The repulsive magnetic field area that is low in the magnetic flux density due to the S3 pole and the S5 pole of the repulsive magnetic poles appears between the S3 pole and the S5 pole of the downstream development sleeve 28.

According to a study made by the inventors of the present invention, it is found that the developer can be prevented from leaking from a space between the upstream and downstream development sleeves when the magnetic flux density of the repulsive magnetic field area is substantially 0, that is, when the S3 pole side (downstream side in the sleeve rotating direction) with respect to the opposing portion of the center position R of the minimum magnetic force has the same polarity.

Figure 9:
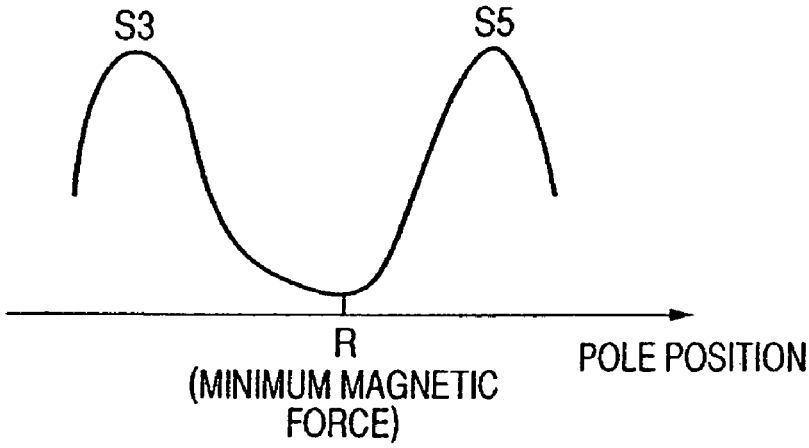
FIG. 9 is a diagram for explaining magnetic flux density in a repulsive magnetic field.

In other words, when the magnetic seal member whose polarity is different exists at the S3 pole side with respect to the opposing portion of the center position R at which the magnetic flux density of the repulsive magnetic field area is substantially 0 as shown in FIG. 9, the developer is transported from the magnetic seal member to the S3 pole of the delivery pole. Therefore, the leakage occurs from the space between the upstream and downstream development sleeves. However, even when the magnetic seal member having the different polarity exists at the S5 polarity side (upstream side in the sleeve rotating direction) with respect to the opposing portion of the center position R at which the magnetic flux density of the repulsive magnetic field area is substantially 0, the developer is not leaked from the space between the upstream and downstream development sleeves because the developer of the magnetic seal member is attracted toward the S5 pole.

Figure 10:
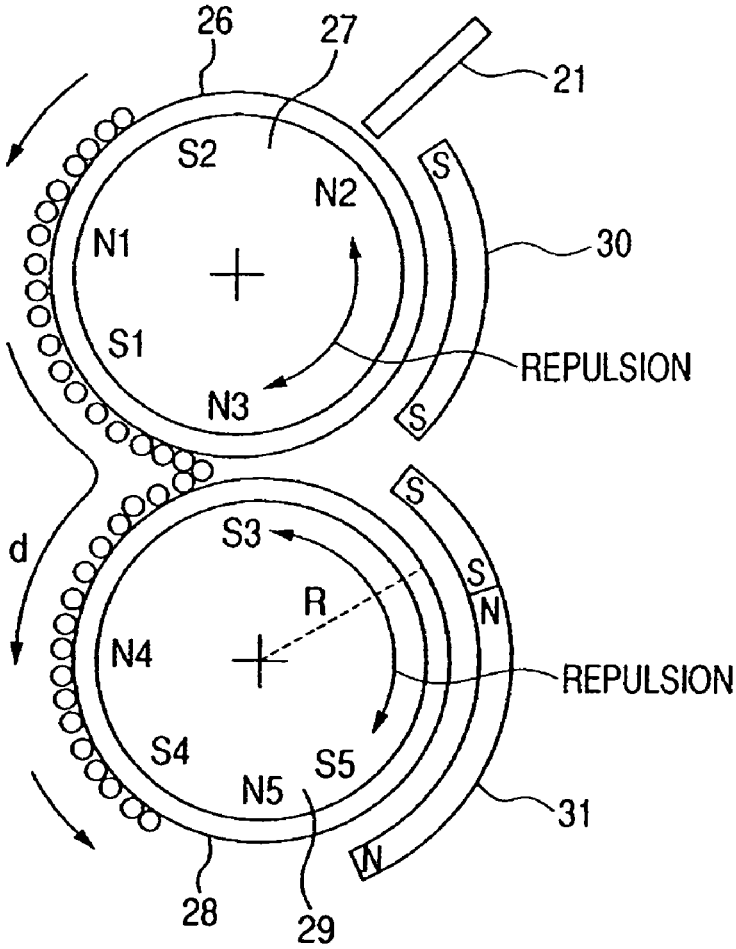
FIG. 10 is a diagram for explaining a developing apparatus according to another embodiment of the present invention.

Under the circumstances, in this embodiment, as shown in FIG. 10, the magnet serving as the magnetic seal member has the same polarity as that of the magnet roller and faces the magnet roller at the downstream side of the opposing portion of the center position R of the minimum magnetic force in the sleeve rotating direction, at which the magnetic flux density of the repulsive magnetic field area of the downstream development sleeve 28 is substantially 0. On the other hand, the magnets having different polarities face each other at the upstream side.

As described above, the magnet has the same polarity as that of the magnet roller and faces the magnet roller at the downstream side of the opposing portion of the center position R in the sleeve rotating direction, at which the magnetic flux density of the repulsive magnetic field area is substantially 0. Therefore, the developer is not leaked from the space between the upstream and downstream development sleeves. On the other hand, the magnet whose polarity is different from that of the magnet roller faces the magnet roller at the upstream side of the opposing portion of the center position R in the sleeve rotating direction, at which the magnetic flux density of the repulsive magnetic field area is substantially 0. The reason is stated below. In the case where the magnet is different in polarity from the magnet roller and faces the magnet roller, because the lines of magnetic force are developed between the magnet serving as the magnetic seal member and the magnet roller within the development sleeve, the magnetic sealing property can be further strongly ensured.

Figure 11:
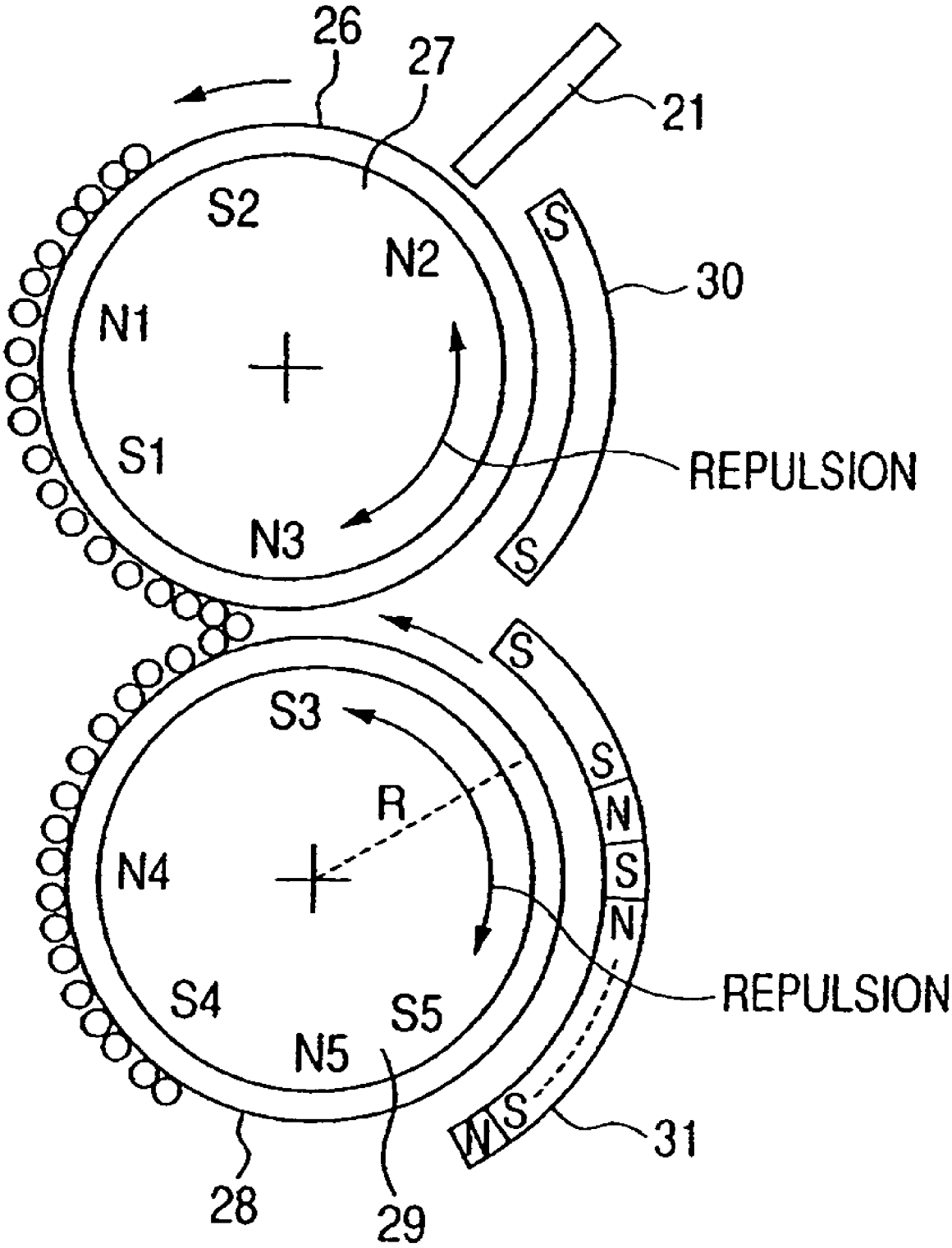
FIG. 11 is a diagram for explaining a developing apparatus according to still another embodiment of the present invention.

In the case where the magnet has the same polarity as that of the magnet roller and faces the magnet roller at the downstream side of the opposing portion of the center position R in the sleeve rotating direction, at which the magnetic flux density of the repulsive magnetic field area is substantially 0, a magnet plate that is alternately magnetized with N and S magnetic poles may be used as the magnetic seal member in the upstream portion as shown in FIG. 11.

Even with the above-mentioned structure, in the developing apparatus having the plurality of development sleeves, the development sleeve end seal using the magnetic brush can be perfectly effected.

Third Embodiment

This embodiment is substantially identical in structure with the above-mentioned first embodiment. Hereinafter, structures different from those in the first embodiment will be mainly described.

In the first embodiment, in the case where the magnet plate 31 serving as the magnetic seal member and the magnet roller 29 are identical in polarity with each other while facing each other, the magnetizable plates 32 are fitted onto the inner surfaces of the side walls at both sides of the developer container 22 so as to surround the peripheral surfaces of the ends of the development sleeves 26 and 28 in the non-contact fashion. With the above-mentioned structure, a problem of the leakage of the developer in the development sleeve end direction is solved.

In other words, because the magnetic field is concentrated on the fore-end of the magnetizable plate 32 and the magnetic brush is formed with a high density, which produces an effect of blocking the movement of the developer in the developer container external direction. In addition, when the magnetizable plate 32 is disposed, the developer that is to leak is suitably held by the magnet plate or the magnet roller to avoid leakage because the areas in which there is substantially no force that is exerted on the magnetic carrier can be prevented from continuously existing along the longitudinal direction of the development sleeve.

With regard to the leakage of the developer in the longitudinal direction of the development sleeves, it is important that the areas in which there is substantially no force that is exerted on the magnetic carrier is prevented from continuously existing along the longitudinal direction of the development sleeve. Under the circumstances, in the first embodiment, the above-mentioned structure is achieved by using the magnetizable plate 32. However, even if the magnetizable plate is not used, the above-mentioned structure can be achieved.

Figure 12A:
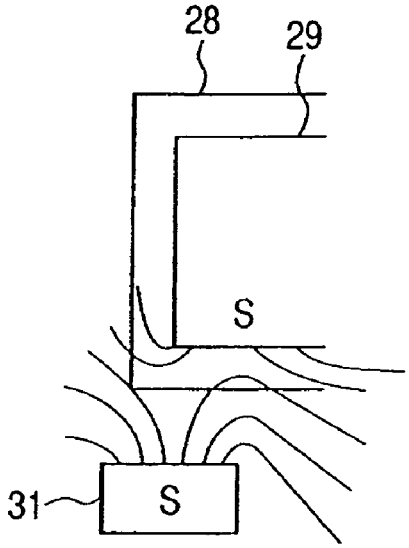
FIGS. 12A, 12B, and 12C are diagrams for explaining lines of magnetic force in the vicinity of a magnetic seal member in a developing apparatus according to another embodiment of the present invention.

For example, even in the case where the magnet plate 31 and the magnet roller 29, which are identical in polarity with each other and formed of the magnetic seal members, face each other, the magnetic force of the magnet plate 31 can be relatively increased with respect to the magnetic force of the magnet roller 29. As a result, as shown in FIG. 12A, the lines of magnetic force from the magnet plate 31 is extended up to the vicinity of the magnet roller 29 within the development sleeve. Therefore, as shown in FIG. 12C, the areas having substantially no magnetic force which are continuously developed between the magnet plate 31 and the magnet roller 29 is formed within the development sleeve 28. As a result, because a force is always exerted between the magnet plate 31 and the development sleeve 28 in the direction of the magnet plate, the developer is suitably held by the magnet plate 31 to avoid leakage.

Figure 12B:
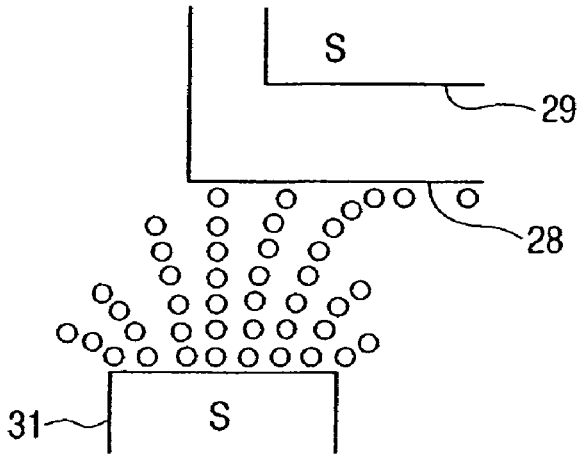
Figure 12C:
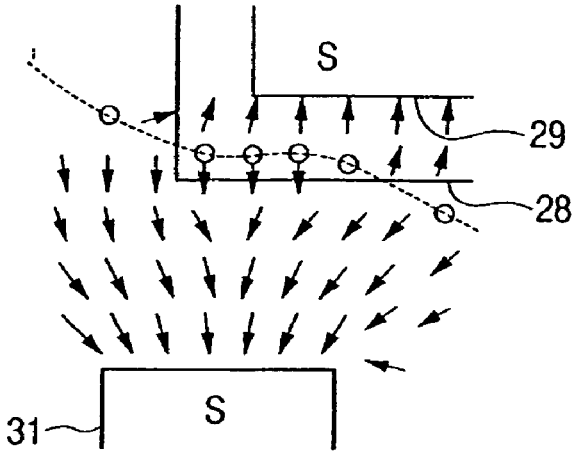

In addition, because the magnetic brush from the magnet plate 31 is produced along the lines of magnetic force, the magnetic brush is produced from the magnet plate 31 in the direction of the development sleeve 28 as shown in FIG. 12B, and the magnetic brush comes into light contact with the development sleeve 28, thereby making it possible to block the leakage of the developer.

In this embodiment, there is used the magnet plate 31 whose surface is 100 mT in the magnetic force which is higher than that of the first embodiment. Also, as shown in FIG. 7, the gap g3 between the magnet plate 31 and the development sleeve 28 is narrowly set to 0.5 mm, to thereby achieve the above-mentioned structure.

Even with the above-mentioned structure, in the developing apparatus having the plurality of development sleeves, the development sleeve end seal using the magnetic brush can be perfectly effected.

The developing apparatus according to the present invention is properly applied to the image forming apparatus of the above-mentioned embodiments which have been described as a color image forming apparatus of the intermediate transfer system. However, the present invention is not limited to those structures. The developing apparatus according to the present invention can be applied to diverse image forming apparatuses such as an image forming apparatus having a feed belt that feeds a transferring material instead of the intermediate transfer belt, or an image forming apparatus having one image bearing member which are known to those skilled in the art.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-259969, filed Sep. 7, 2005, which is hereby incorporated by reference herein in its entirety.

What is claimed is:

1. A developing apparatus, which develops an electrostatic image on an image bearing member by using a developer containing magnetic particles, said developing apparatus comprising:

a developer container, which contains the developer;

a first developer carrying member that is rotatably disposed in said developer container, and carries and transports the developer toward a first development area;

a second developer carrying member that is rotatably disposed in a vicinity of said first developer carrying member in said developer container, and carries and transports the developer delivered from said first developer carrying member in a developer delivery region toward a second development area;

a first magnetic field generating member, which is disposed in said first developer carrying member and has a plurality of magnetic poles, said first magnetic field generating member having a first magnetic pole at a position facing the developer delivery region;

a second magnetic field generating member, which is disposed in said second developer carrying member and has a plurality of magnetic poles, said second magnetic field generating member having a second magnetic pole that is different in polarity from said first magnetic pole at a position facing the developer delivery region;

a first magnet member disposed in a vicinity of an axial end of said first developer carrying member along a peripheral surface of said first developer carrying member without facing said first magnetic pole; and a second magnet member disposed in a vicinity of an axial end of said second developer carrying member along a peripheral surface of said second developer carrying member without facing said second magnetic pole, a surface facing said second developer carrying member in a downstream end area of said second magnet member in a rotating direction of said second developer carrying member being identical in polarity with said second magnetic pole.

2. A developing apparatus according to claim 1, wherein said second magnetic field generating member has a third magnetic pole disposed adjacently upstream of said second magnetic pole in the rotating direction of said second developer carrying member, said third magnetic pole being identical in polarity with said second magnetic pole; and a surface of said second magnet member which faces an area downstream of a position having a minimum magnetic force between said second magnetic pole and said third magnetic pole of said second developer carrying member in the rotating direction of said second developer carrying member is identical in polarity with said second magnetic pole.

3. A developing apparatus according to claim 1, further comprising magnetizable members disposed in vicinities of the axial ends of said first developer carrying member and said second developer carrying member along the peripheral surfaces of said first developer carrying member and said second developer carrying member, respectively.

4. A developing apparatus according to claim 1, wherein said second magnet member has an area that is different in polarity from at least one magnetic pole of said second magnetic field generating member, said area facing said one magnetic pole.

5. A developing apparatus according to claim 1, wherein said first magnetic field generating member has a fourth magnetic pole disposed adjacently downstream of said first magnetic pole in the rotating direction of said first developer carrying member, said fourth magnetic pole being identical in polarity with said first magnetic pole; and a surface of said first magnet member which faces said first developer carrying member in an end area upstream of said first magnet member in the rotating direction of said first developer carrying member is different in polarity from said first magnetic pole.

6. A developing apparatus according to claim 1, wherein, in a space defined between a surface of said second magnet member which faces said second developer carrying member in an end area downstream of said second magnet member in the rotating direction of said second developer carrying member, and the surface of said second developer carrying member, an area of the developer in which a magnetic force exerted on the magnetic particles is equal to or more than $1\times10^{-6}$ (N) is in contact with both of the surfaces of said second magnet member and said second developer carrying member.

7. A developing apparatus according to claim 1, wherein the developer comprises a two-component developer including a magnetic carrier and a toner.

8. A developing apparatus according to claim 1, wherein the developer comprises a mono-component developer including a magnetic toner.

* * * * *